US009405274B2

(12) United States Patent
Cattaneo et al.

(10) Patent No.: US 9,405,274 B2
(45) Date of Patent: Aug. 2, 2016

(54) TIME PIECE CAPABLE OF DISPLAYING TWO TIME ZONES

(75) Inventors: Julien Cattaneo, Esery (FR); Marco La China, Geneva (CH); Denis Rudaz, Segny (FR); Martin Breuilh, Saint-Julien-en-Genevois (FR); Frederic Jolliet, Geneva (CH)

(73) Assignee: ROLEX SA, Geneva (CH)

( * ) Notice: Subject to any disclaimer, the term of this patent is extended or adjusted under 35 U.S.C. 154(b) by 229 days.

(21) Appl. No.: 14/342,307

(22) PCT Filed: Aug. 30, 2012

(86) PCT No.: PCT/EP2012/066850

§ 371 (c)(1),
(2), (4) Date: Jun. 17, 2014

(87) PCT Pub. No.: WO2013/030268

PCT Pub. Date: Mar. 7, 2013

(65) Prior Publication Data

US 2014/0321247 A1 Oct. 30, 2014

(30) Foreign Application Priority Data

Sep. 1, 2011 (EP) ..... 11405310

(51) Int. Cl.
*G04B 19/22* (2006.01)
*G04B 27/02* (2006.01)

(52) U.S. Cl.
CPC ..... *G04B 19/223* (2013.01); *G04B 19/221* (2013.01); *G04B 27/023* (2013.01)

(58) Field of Classification Search
CPC .... G04B 19/22; G04B 19/221; G04B 19/223; G04B 27/023
USPC ..... 368/21, 27
See application file for complete search history.

(56) References Cited

U.S. PATENT DOCUMENTS 2,456,122 A * 12/1948 Guilden ..... G04B 19/223 368/192
3,702,056 A * 11/1972 Zoli ..... G04B 19/223 368/27
3,710,567 A * 1/1973 Cleusix ..... G04B 19/25 368/35

(Continued)

FOREIGN PATENT DOCUMENTS

EP 2008159 A2 12/2008
EP 2008159 B1 6/2010

(Continued)

OTHER PUBLICATIONS

European Application No. 11405272.3, filing date of Jun. 21, 2011; corresponds to WO2012/175595.

(Continued)

*Primary Examiner* — Vit W Miska
(74) *Attorney, Agent, or Firm* — Westerman, Hattori, Daniels & Adrian, LLP

(57) ABSTRACT

Device (300; 200) for displaying the time, comprising a time-display member (A1, A2) and a switchover mechanism (100) allowing the time-display member to switch between a first time zone and a second time zone. This switchover mechanism comprises: a first heart piece (3) capable of rotating; a first lever (1) having a first end (1*a*) designed to collaborate with the first heart piece (3) with a view to causing the display member (A1, A2) to indicate the time in the first time zone; a second lever (2; 42) designed to cause the display member (A1, A2) to indicate the time of the second time zone; a two-position selector member (5) collaborating with the first lever (1), and a control member (P) allowing selection of the first or the second time zone for display. The two-position selector member (5) is designed to collaborate directly with a second end (1*b*) of the first lever (1).

33 Claims, 20 Drawing Sheets

(56) References Cited

U.S. PATENT DOCUMENTS

Figure 1:
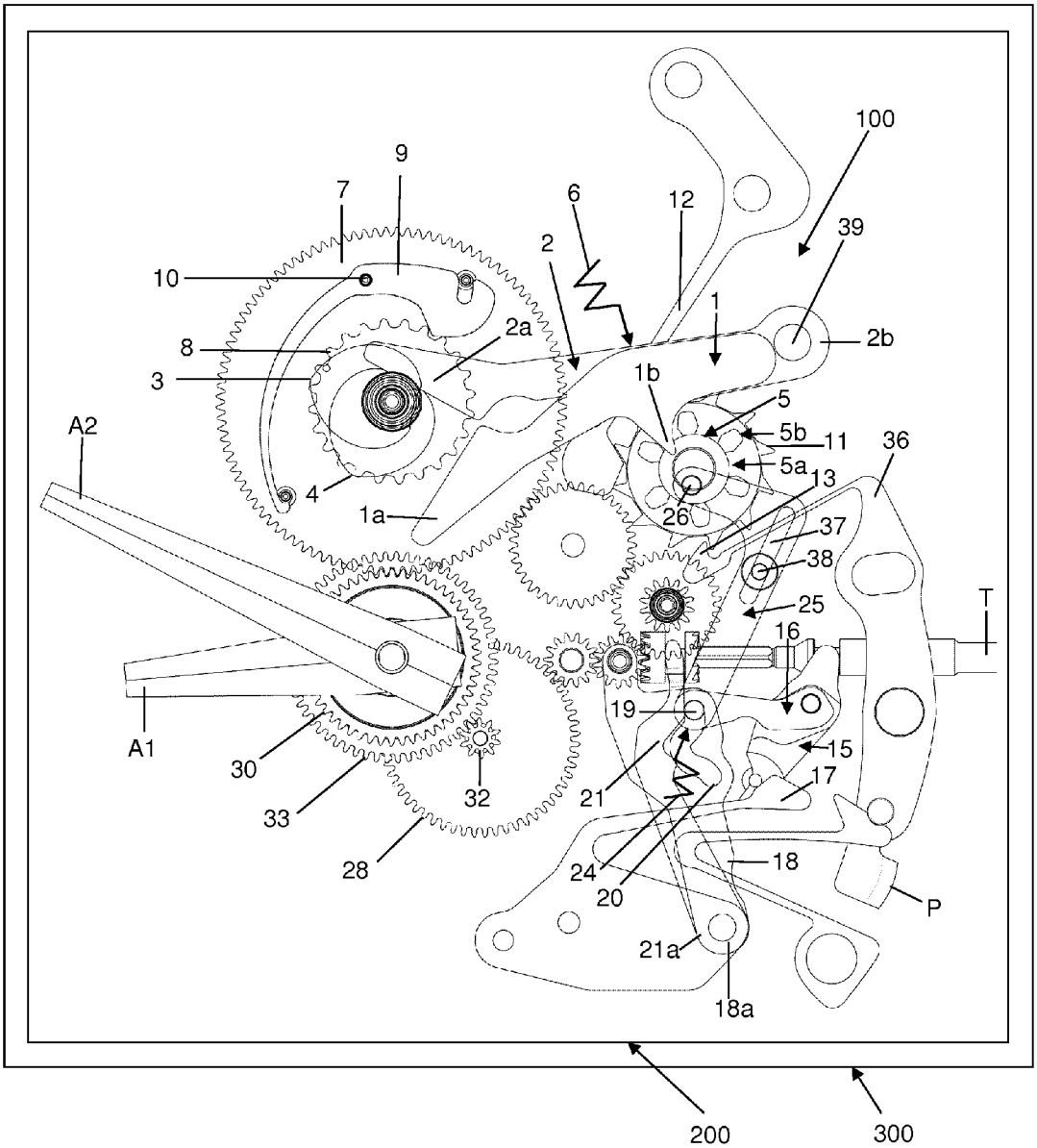

| | | | | |
|---|---|---|---|---|
| 3,871,169 | A | 3/1975 | Schwaar et al. | |
| 4,681,460 | A * | 7/1987 | Nishimura | G04G 9/0076 368/21 |
| 5,210,721 | A * | 5/1993 | Kikuchi | G04B 27/00 368/21 |
| 2011/0205852 | A1 | 8/2011 | Zaugg et al. | |
| 2012/0020192 | A1 * | 1/2012 | Calabrese | G04B 19/235 368/106 |

FOREIGN PATENT DOCUMENTS

| | | | |
|---|---|---|---|
| EP | 2362277 | A1 | 8/2011 |
| FR | 2207302 | A1 | 6/1974 |
| WO | 2007/115984 | A2 | 10/2007 |
| WO | 2012/175595 | A1 | 12/2012 |

OTHER PUBLICATIONS

Denis Rudaz et al., "Timepiece comprising a winding mechanism and at least one mechanism for correcting at least one indicator member", U.S. Appl. No. 14/124,962, filed Dec. 9, 2013.

International Search Report, dated Jan. 2, 2013, issued in corresponding application No. PCT/EP2012/066850.

* cited by examiner

TIME PIECE CAPABLE OF DISPLAYING TWO TIME ZONES

The invention relates to a time displaying device, notably a timepiece, particularly a wristwatch, or a timepiece movement comprising a mechanism allowing the time displaying member to switch over between two time zones.

BACKGROUND OF THE INVENTION

European patent application published under No. EP 2 008 159 describes a wristwatch provided with a switchover mechanism capable of making one and the same display member selectively indicate the time in one or other of two time zones. The single hours hand selectively displays either the local time or the time in the second time zone, under actuation by a push-button. The switchover mechanism comprises a heart piece and two levers. The time difference between the local time and the time in the second time zone is determined by the relative position of one lever with respect to the other.

The switchover mechanism described in the abovementioned document has the notable disadvantage of including display selection and setting mechanisms which are extremely complex and involve two differentials and an extremely high number of components. In addition, each of the time zones is set using distinct correction geartrains which are independent of the switchover mechanism. It then follows that it is possible to modify one time zone when it is the other time zone that is being displayed.

European patent application published under No. EP 2362277 also describes a timepiece of which the mechanism, under actuation by a push-button, is capable of causing the same hours hand selectively to indicate the time in one or other of two time zones. The device uses a bistable hammer, and two heart piece memory wheels, each one dedicated to a specific time zone, which are kinematically linked within one and the same geartrain which is in mesh with an input of a differential. The time difference between the two time zones is determined by the relative position of the two heart pieces and this is governed by the bistable hammer. Each of the memory wheels also comprises means for setting the time zone which is displayed by the timepiece.

The display setting and switchover mechanisms described in the aforementioned document have the notable disadvantage of being dissociated from the mechanism that sets the hours and minutes of the timepiece. As a result, that device can never in itself be sufficient and has to be combined with a second mechanism so that all of the settings of the timepiece can be carried out. Moreover, that situation demands that there be an additional setting member in addition to the member that sets the time zones, and therefore has impacts on the external parts of the timepiece.

BRIEF DESCRIPTION OF THE INVENTION

It is a major objective of the invention to propose a time displaying device, notably a timepiece, such as a wristwatch, which is able selectively to display two time zones using a switchover mechanism that is simple and made up of a limited number of components. Another objective of the invention is to propose a time displaying device of simple reliable and robust construction that allows easy correction of one and other of the time indications of the two time zones.

According to a first aspect of the invention, the display device comprises a time display member and a switchover mechanism allowing the time display member to switch over between a first time zone and a second time zone and/or to select a first geartrain for setting the first time zone or a second geartrain for setting the second time zone, this switchover mechanism comprising:

- a first heart piece able to rotate, connected to the display member by a drivetrain,
- a first lever having a first end designed to collaborate with the first heart piece in order to cause the display member to indicate the time in the first time zone,
- a second lever designed to make the display member indicate the time in the second time zone,
- a two-position selection member collaborating with the first lever, and
- a control member for selecting the first or the second time zone to be displayed and which collaborates with the two-position selection member, characterized in that the two-position selection member is designed to collaborate directly with a second end of the first lever.

Various embodiments are as follows:

- The first lever and the second lever each have an elongate shape overall.
- The first lever and the second lever are joined together.
- The first lever is fixed to the second lever.
- The first lever has an elongate shape overall and the second lever has a part that forms a spring.
- The second lever constantly presses against the first heart piece.
- The device comprises a second heart piece coaxial with the first heart piece, able to rotate independently of the latter, connected to the display member by a second drivetrain and designed to collaborate with said second lever.
- The device comprises a control stem able to occupy at least two positions, the control stem, in one of these positions, collaborating with the control member and/or with the selection member so as to set the time in the first or second time zone selected by the control member and displayed by the display member.
- The positions of the control stem comprise a rewind position and a time-setting position, the control stem, in the time-setting position, collaborating with the control member and/or with the selection member so as to set the time in the first or second time zone selected by the control member and displayed by the display member.
- A winding pinion is mounted on the control stem and rotates as one therewith.
- The control stem comprises a sliding pinion provided with a contrate toothset and with a crown toothset.
- The device comprises a clutch perpendicular to the longitudinal axis of the control stem and collaborating with a winding pinion so as to actuate the winding mechanism.
- The first and second setting geartrains are distinct.
- The device comprises selection means for selecting the first or second setting geartrain corresponding to the time zone selected and displayed by the display member and by means of which the time is to be set.
- The control stem collaborates with a pull-out piece itself collaborating, firstly, with at least one rocking lever to set the time, and secondly, with said selection means that select the setting geartrain.
- The means for selecting the setting geartrain comprise, firstly, a second pull-out piece collaborating with the first pull-out piece, a first rocking lever and a second rocking lever and, secondly, a follower collaborating with the second pull-out piece, the first rocking lever, the second rocking lever and the column wheel.

The selection means that select the setting geartrain comprise a cam and an arm provided on the first lever and collaborating with the cam.

One end of the arm of the lever is designed to collaborate with a pin fixed to the cam so as to cause the latter to pivot in such a way that it drives a rocking lever via the rotating of the pull-out piece.

The first and second setting geartrains are connected to two distinct inputs of a differential.

One or other of the two setting geartrains is kinematically connected to the minutes indication.

The device comprises a hand designed to indicate the time in the time zone selected by the control member over a 24-hour cycle.

The display member collaborates with the control member in such a way as to be visible only when one of the two time zones is displayed.

The device comprises a dial provided with an aperture and a mask provided between the display member and a dial of the device, in order, depending on the position of the first lever to either mask or not mask the part of the display member that is situated facing the aperture.

The mask is fixed to the first lever or collaborates therewith.

According to a second aspect of the invention, the display device comprises a time display member, notably a time display member that displays through the intermediary of moving parts, and a switchover mechanism allowing the time display member to switch over between two time zones, characterized in that it further comprises a display member for displaying the time difference between the two time zones, notably in number of hours.

Various embodiments are as follows:

The display member collaborates with the control member in such a way as to be visible only when one of the two time zones is displayed.

The switchover mechanism comprises:

a heart piece able to rotate, connected to the display member by a drivetrain, a first lever having a first end designed to collaborate with the heart piece in order to cause the display member to indicate the time in the one of the two time zones, a second lever designed to make the display member indicate the time in the other time zone, a two-position selection member collaborating with the first lever, and a control member for selecting one or other of the time zones to be displayed and which collaborates with the two-position selection member.

The device comprises a dial provided with an aperture and a mask provided between the display member and a dial of the device, in order, depending on the position of the lever to either mask or not mask the part of the display member that is situated facing the aperture.

The mask is fixed to the first lever or collaborates therewith.

According to the invention, the aforementioned objective is achieved by means of a time displaying device provided with a switchover mechanism comprising:

a heart piece able to rotate, connected to the display member by a drivetrain, a first lever having a first end designed to collaborate with the heart piece in order to cause the display member to indicate the time in one of the two time zones, a second lever designed to make the display member indicate the time in the other time zone, a two-position selection member or binary selection member, for example a column wheel or even a bistable member, notably a wig-wag, collaborating with the first lever, and positioning it in one or other of two stable positions, and a control member, for example a push-button, for selecting one or other of the time zones to be displayed and which collaborates with the two-position selection member, this device being distinguished in that the two-position selection member is designed to collaborate directly with a second end of the first lever.

By virtue of this direct collaboration between the first lever and the two-position selection member, it is possible to simplify the mechanism greatly, notably by appreciably reducing the number of parts involved.

According to a first embodiment of the invention, the first lever and the second lever each have an elongate shape overall.

According to a second embodiment of the invention, the first lever has an elongate shape overall and the second lever has a part that forms a spring.

One notable objective of the invention is also to propose a time displaying device able to set or correct just one time zone when this one is displayed.

This objective is achieved by providing in the time displaying device defined hereinabove a control stem able to occupy at least two positions, for example, a rewinding position and a time setting position, this control stem, in one of these positions, collaborating with the control member so as to set the time selected by this member and displayed by the display member A1, A2. In order to avoid any risk of confusion in the setting of the time, it is not possible to actuate the control member when the control stem is in the time-setting position.

Advantageously, the time displaying device comprises a first geartrain for setting the first time zone and a second geartrain for setting the second time zone.

According to one advantageous embodiment of the invention, the time displaying device comprises means for selecting the setting geartrain corresponding to the time zone selected and displayed by the display member A1, A2 and by means of which the time is to be set. More specifically, one or other of the two setting geartrains corresponding to the time zone selected may notably include the means for setting the minutes indication. Thus, the setting of one or other of the two time zones through the same operation fully sets the time of the time displaying device.

According to a second aspect, the invention relates in general to a time displaying device comprising a time display member A1, A2 and a switchover mechanism allowing the time display member to switch over between two time zones, this timepiece being distinguishable in that it further comprises a display member D for displaying the time difference between the two time zones, notably in number of hours.

According to one advantageous embodiment of the time displaying device according to this second aspect, the display member D collaborates with the control member P in such a way as to be visible only when one of the two time zones is displayed.

According to another advantageous embodiment of the time displaying device according to the second aspect of the invention, the switchover mechanism comprises:

a heart piece able to rotate, connected to the display member A1, A2 by a drivetrain, a first lever having a first end designed to collaborate with the heart piece in order to cause the display member A1, A2 to indicate the time in one of the two time zones, a second lever designed to make the display member indicate the time in the other time zone, a two-position selection member collaborating with the first lever, and a control member P for selecting one or other of the time zones to be displayed and which collaborates with the two-position selection member.

According to another advantageous embodiment of the time displaying device according to the second aspect of the invention, the switchover mechanism comprises a dial provided with an aperture G and a mask M provided between the display member D and a dial of the time displaying device, in order, depending on the position of the lever to either mask or not mask the part of the display member D that is situated facing the aperture G. This mask M may possibly be fixed to the first lever or collaborate therewith, notably via an appropriate geartrain.

Figure 2:
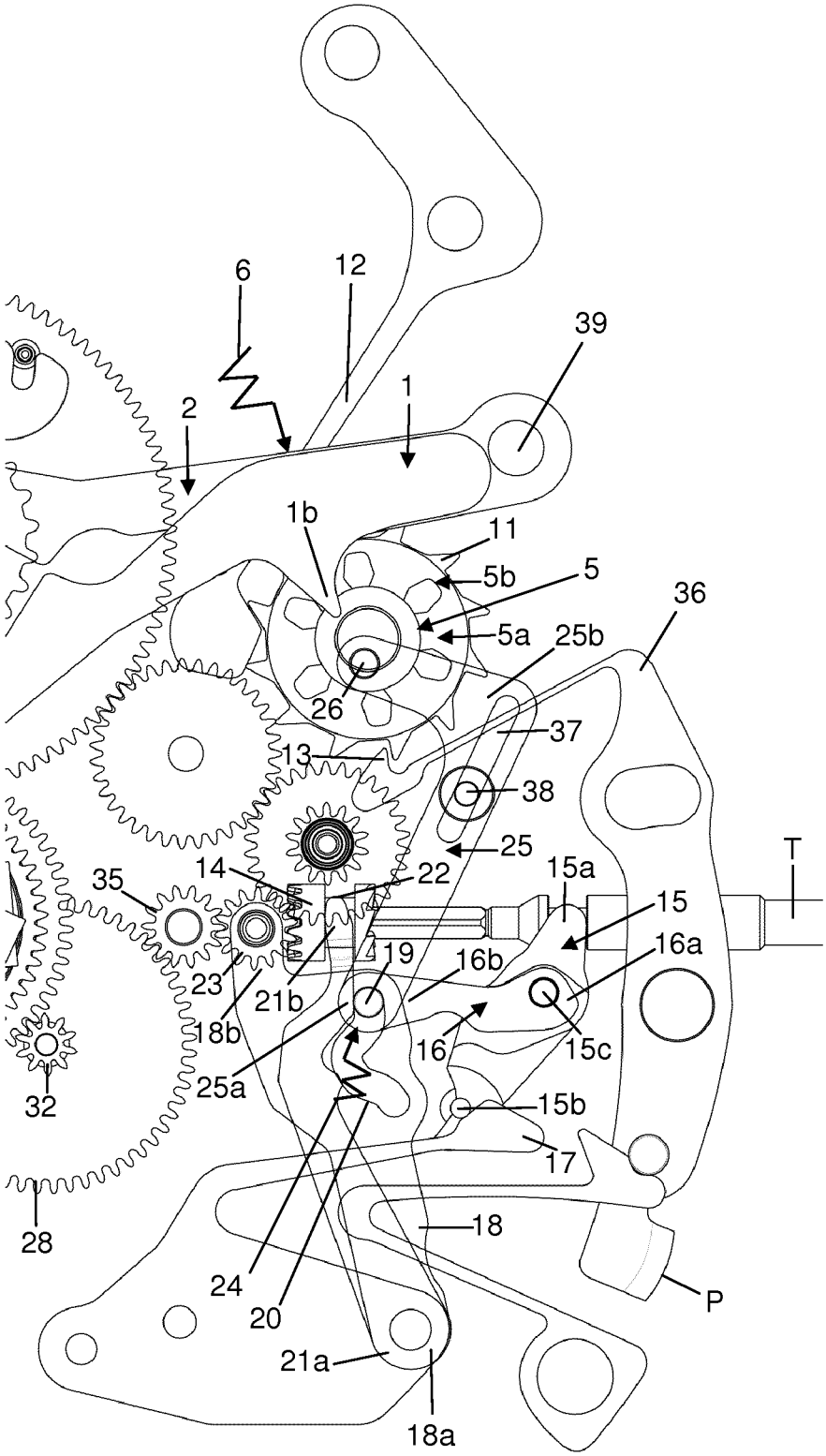
Figure 3:
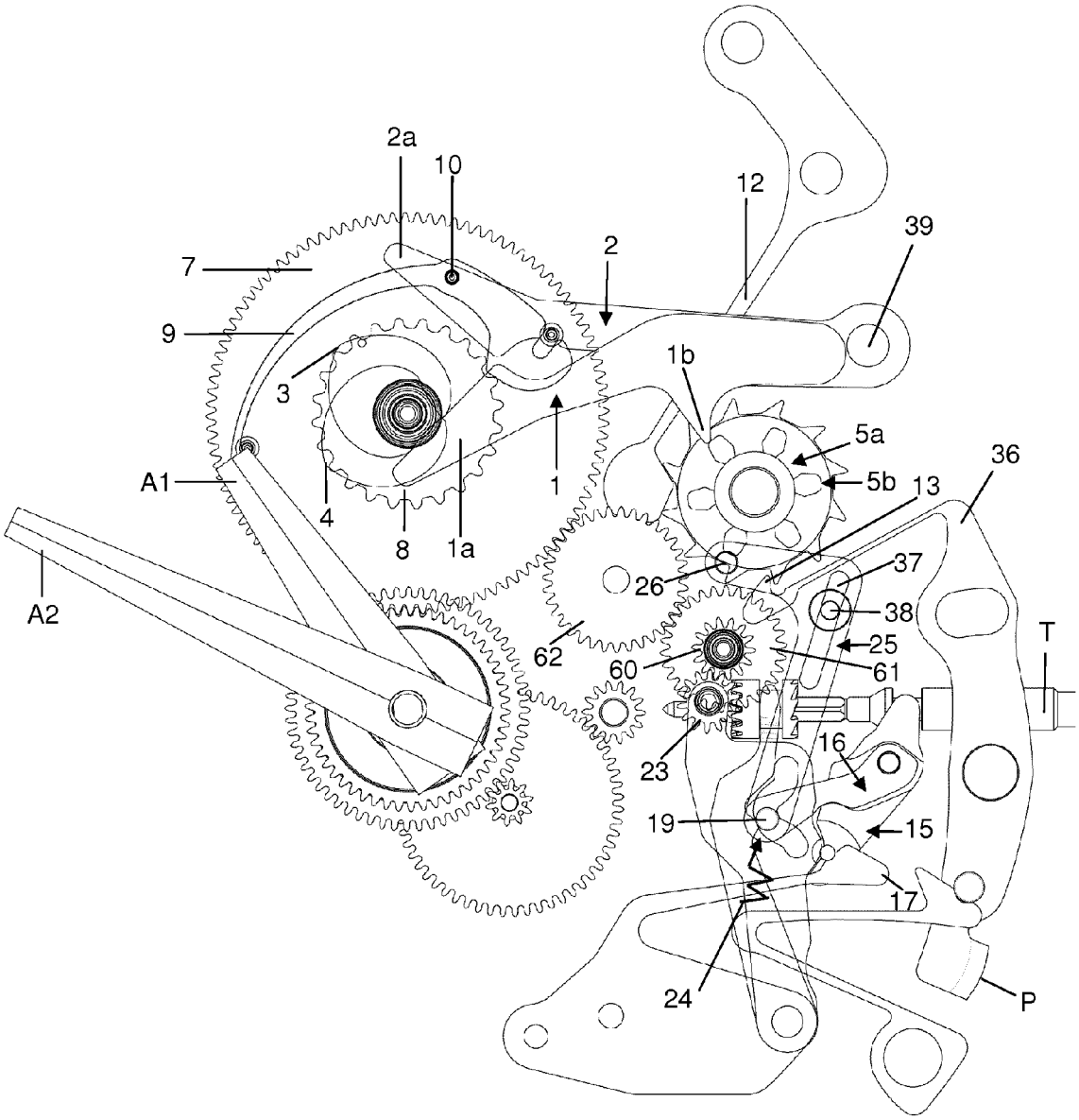
Figure 4:
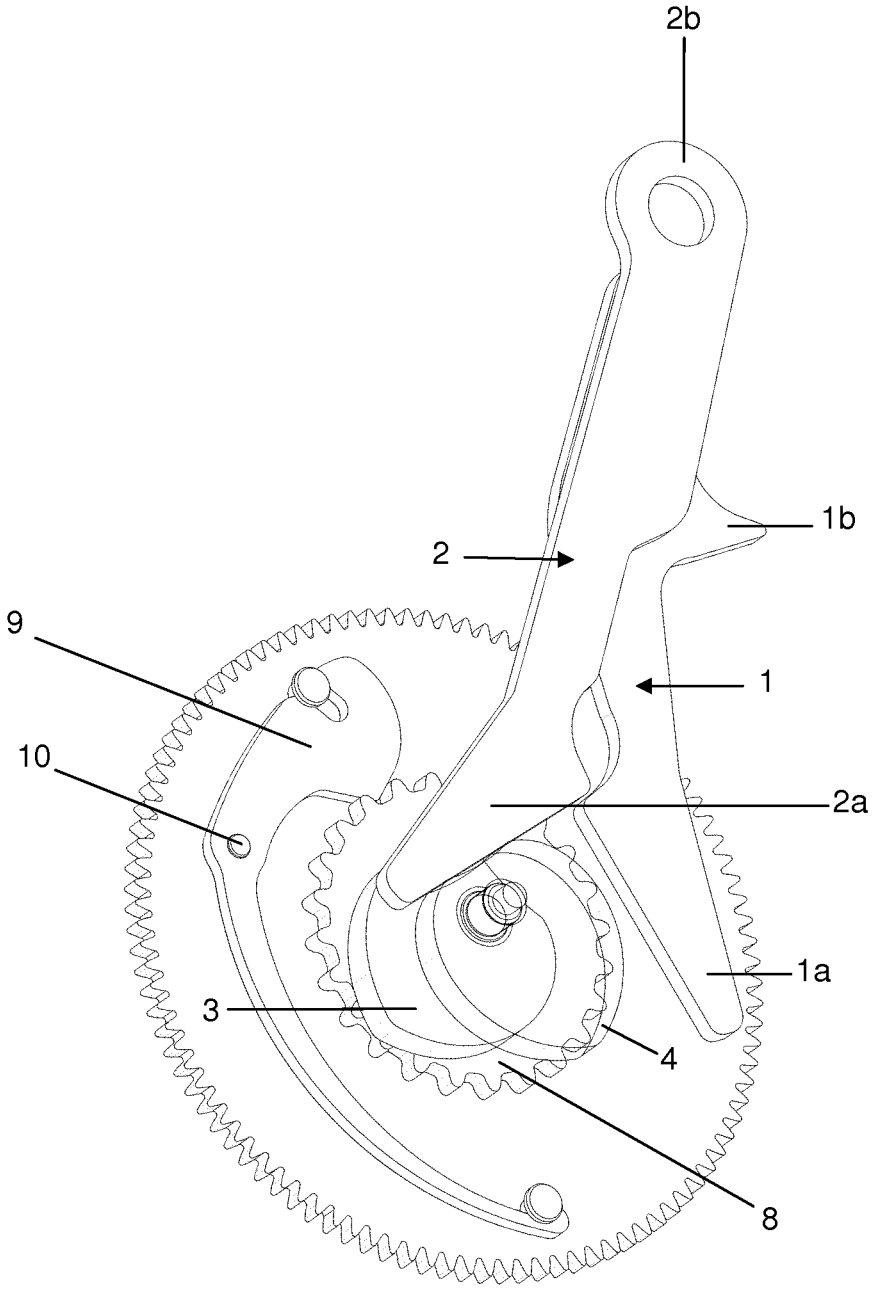
Figure 5:
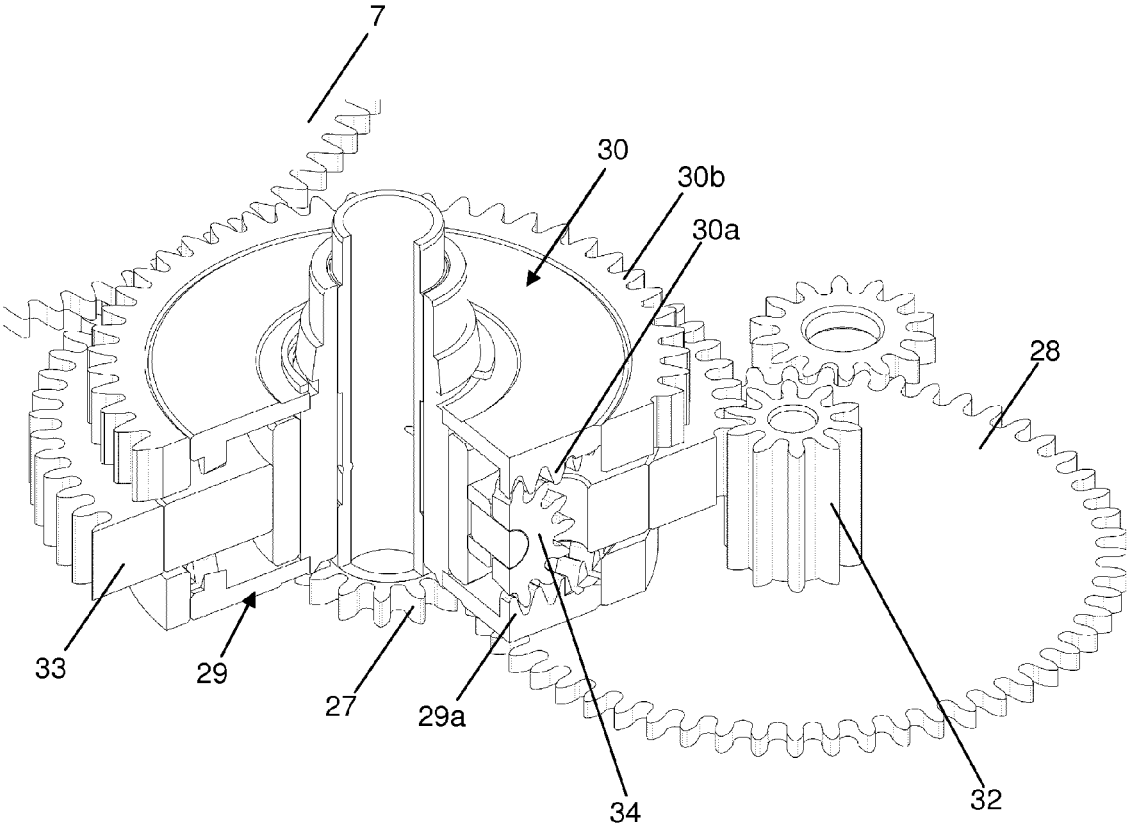
Figure 6:
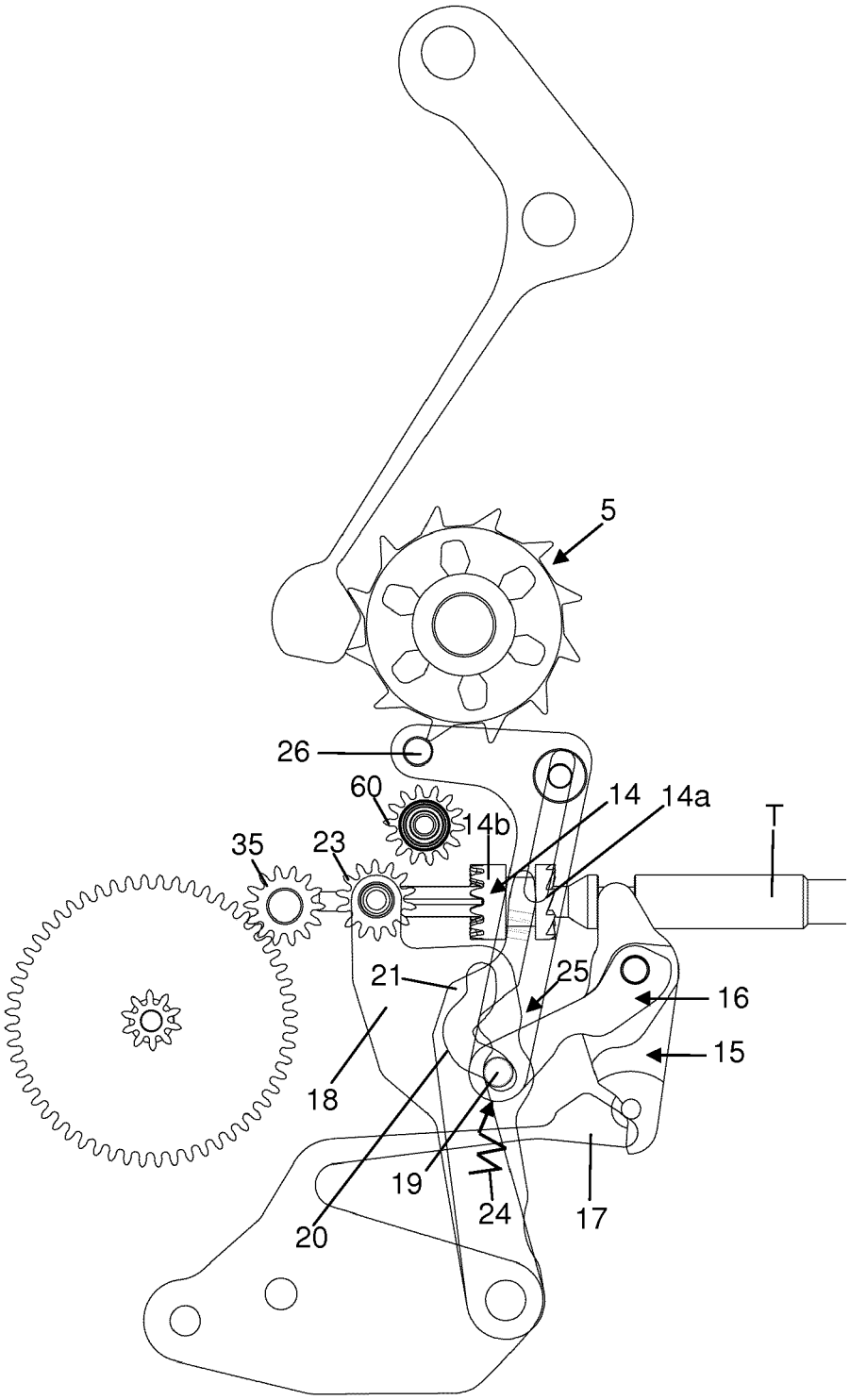
Figure 7:
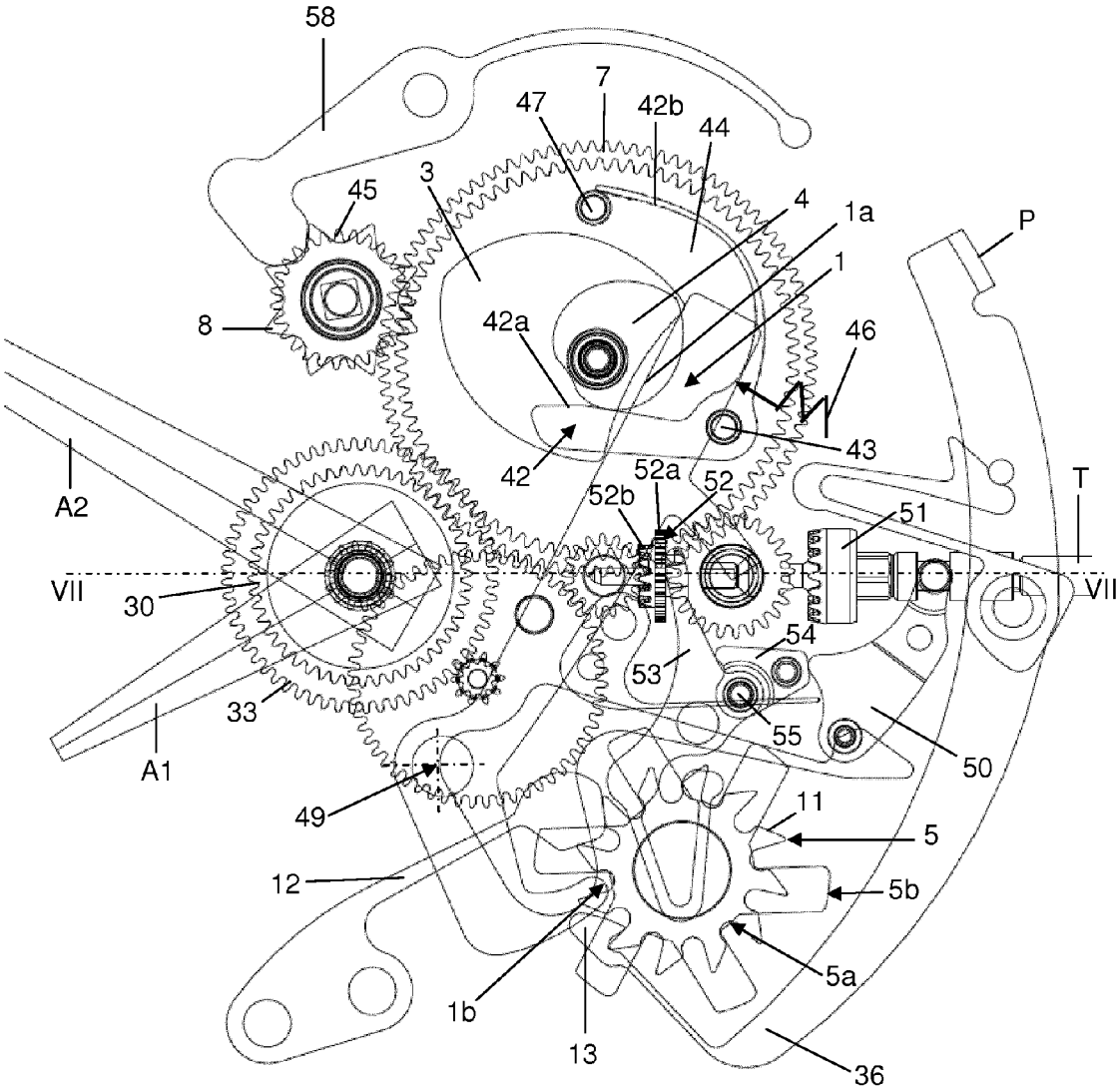
Figure 8:
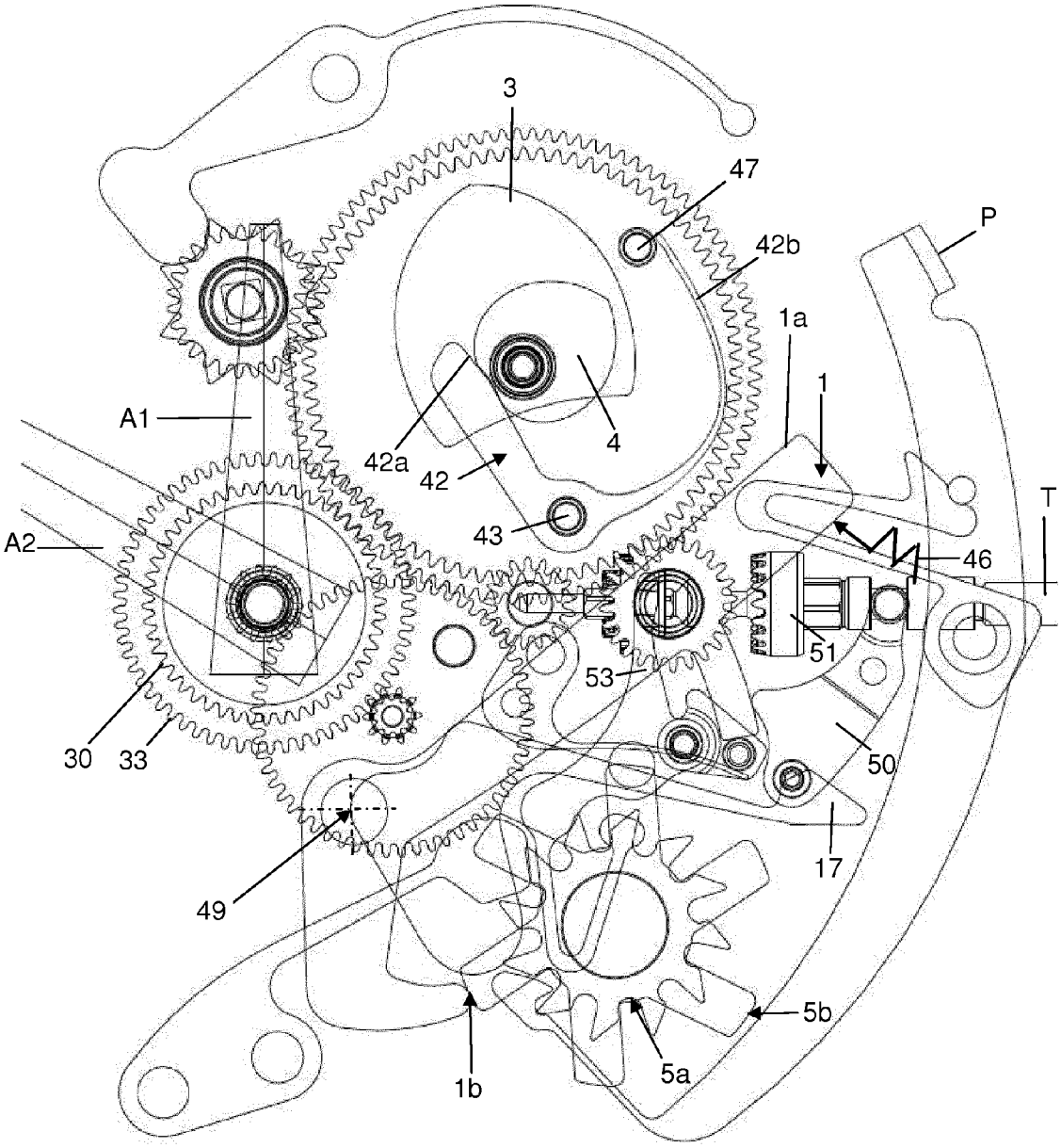
Figure 9:
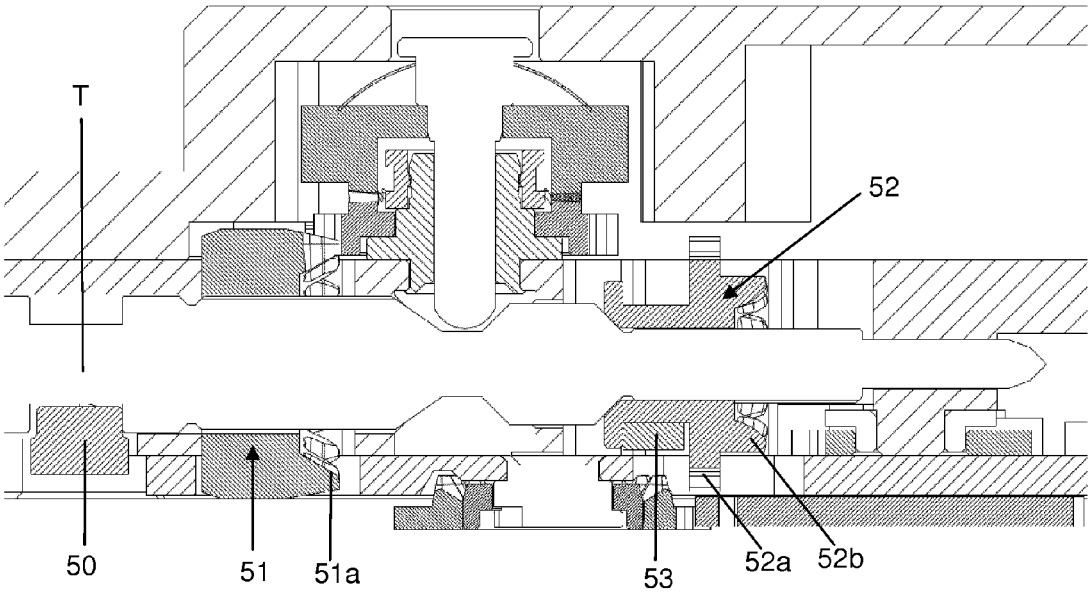
Figure 10:
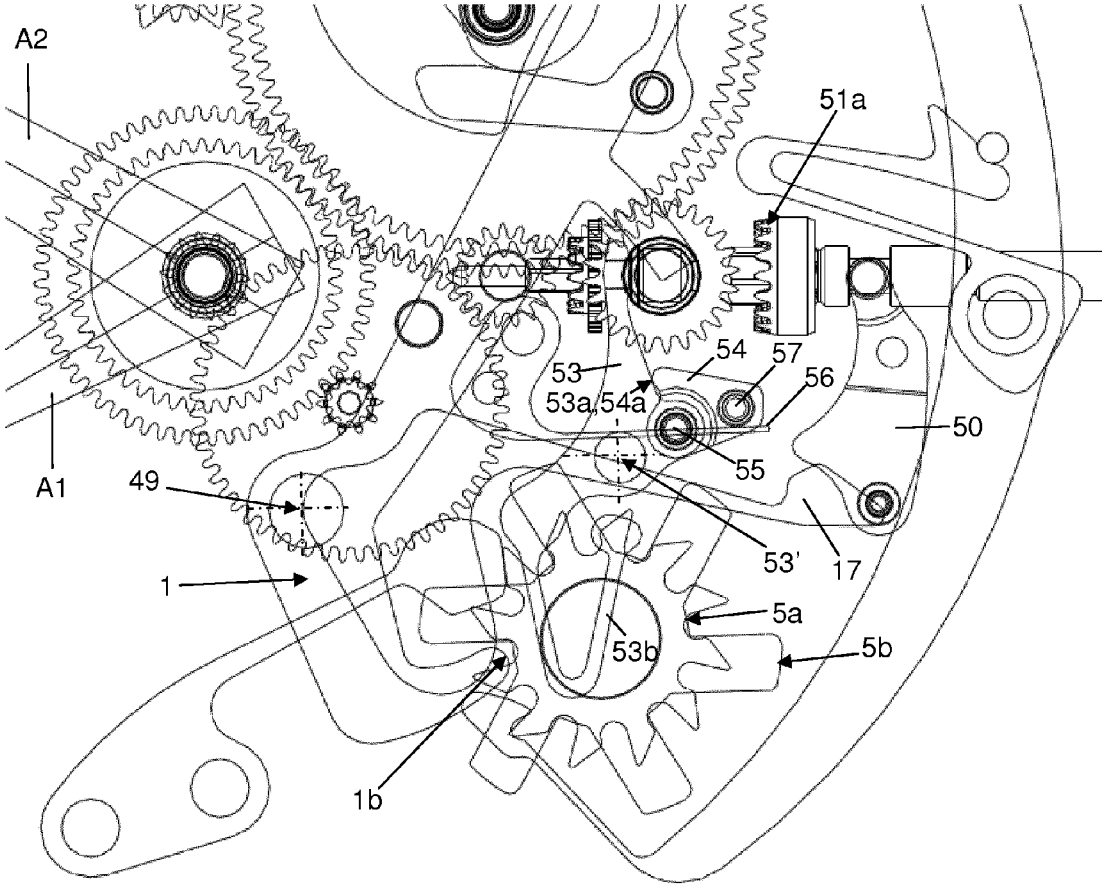
Figure 11:
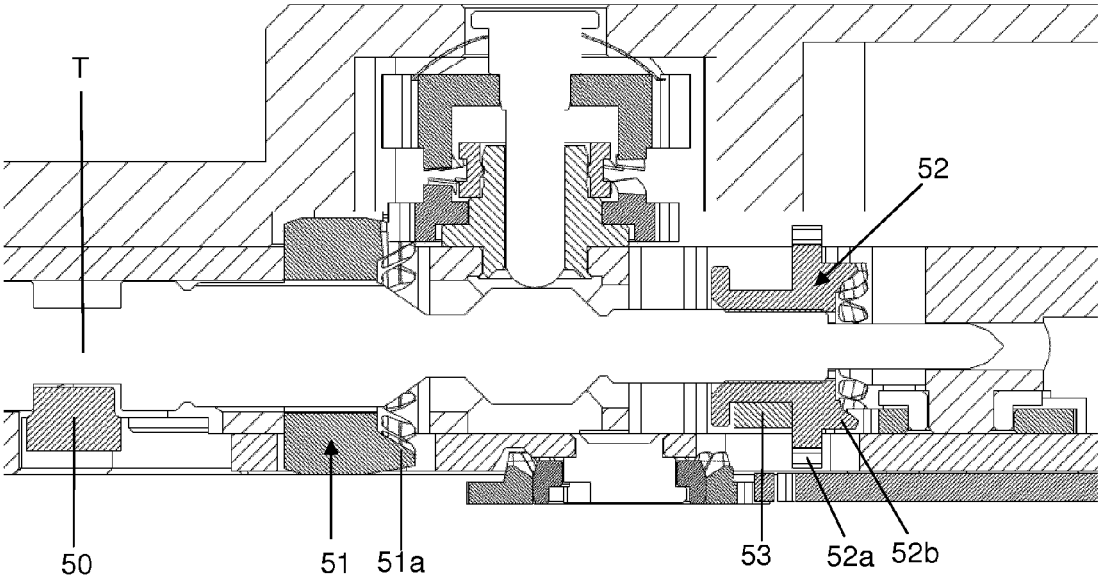
Figure 12:
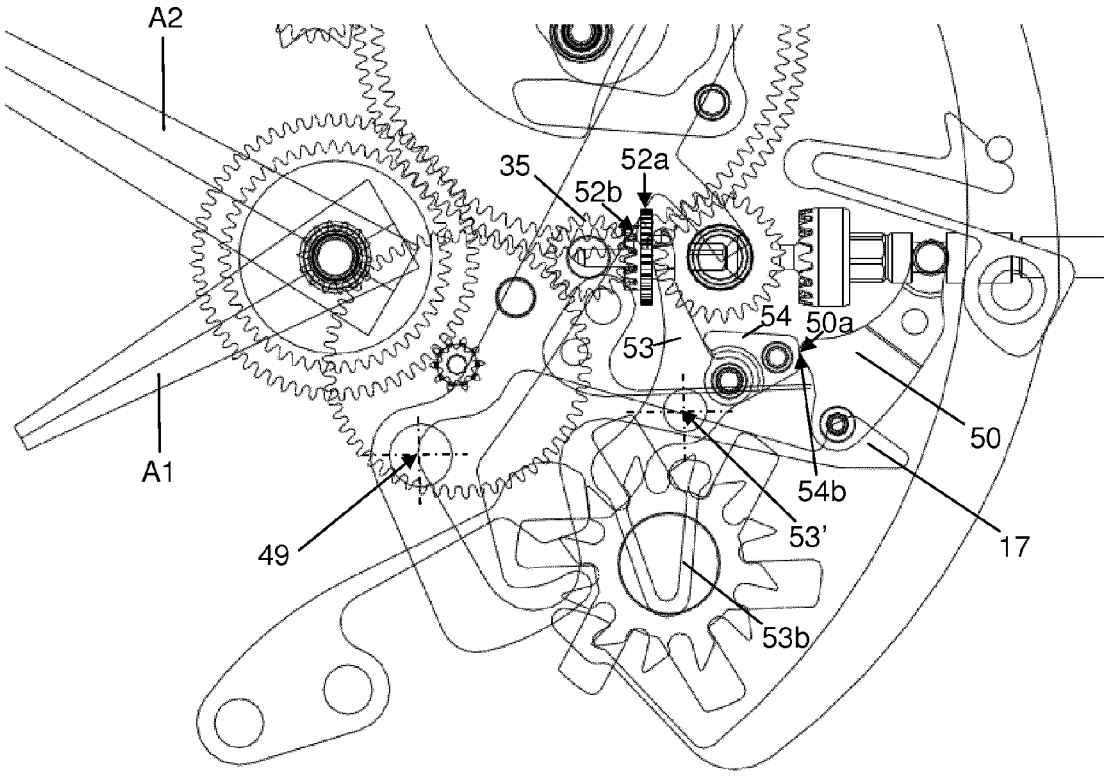
Figure 13:
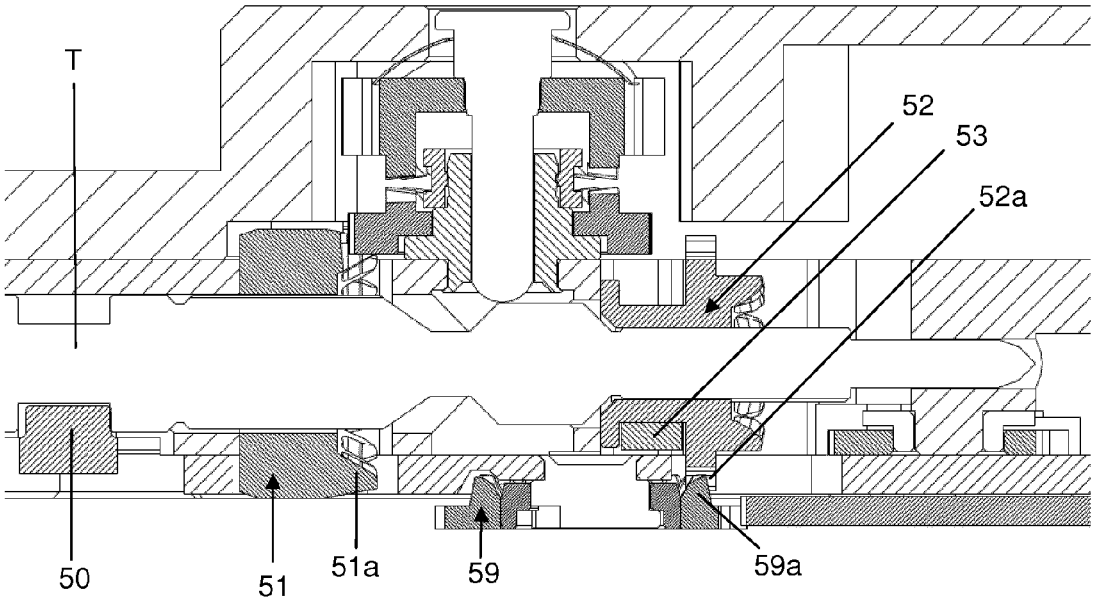
Figure 14:
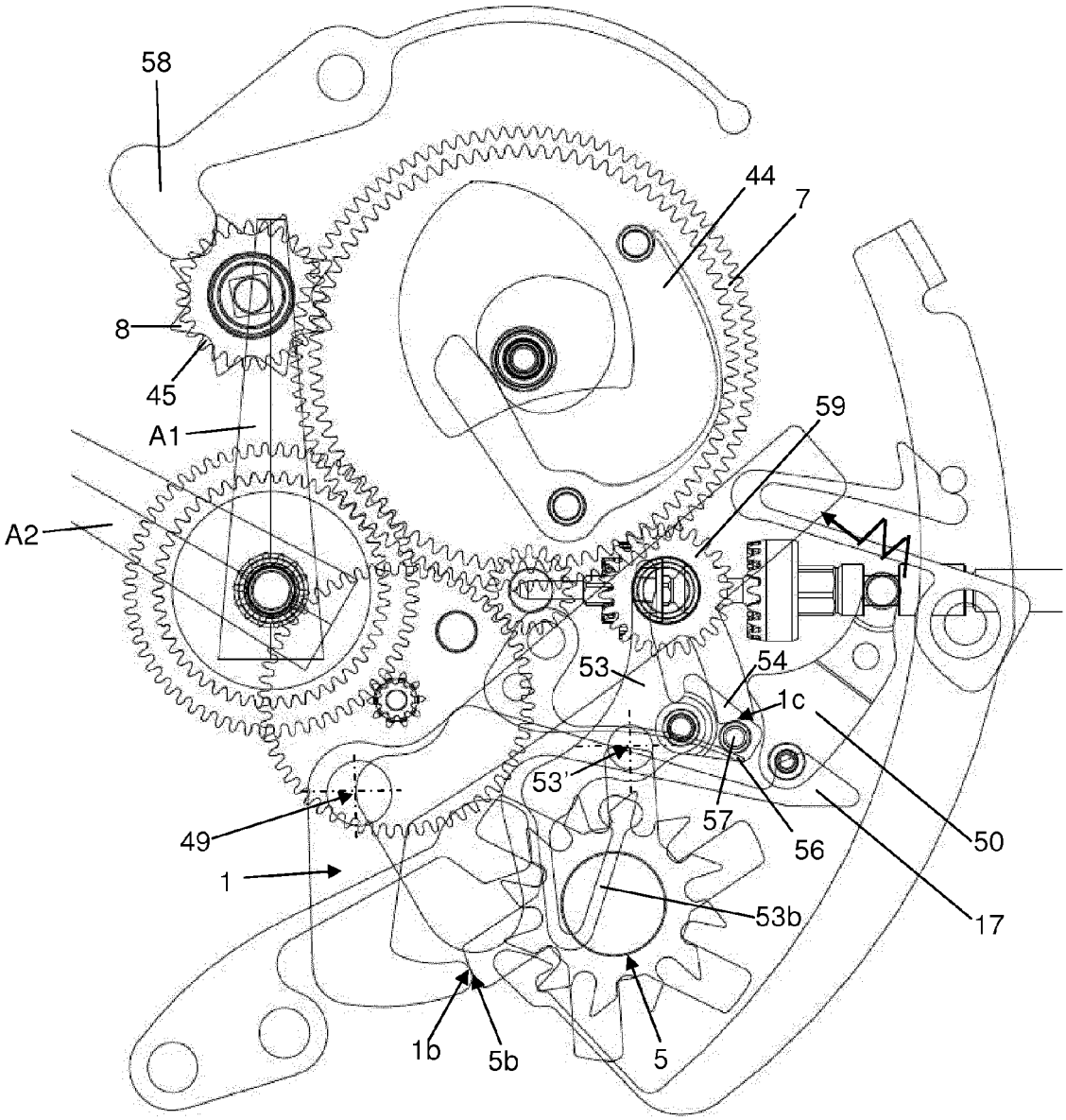
Figure 15:
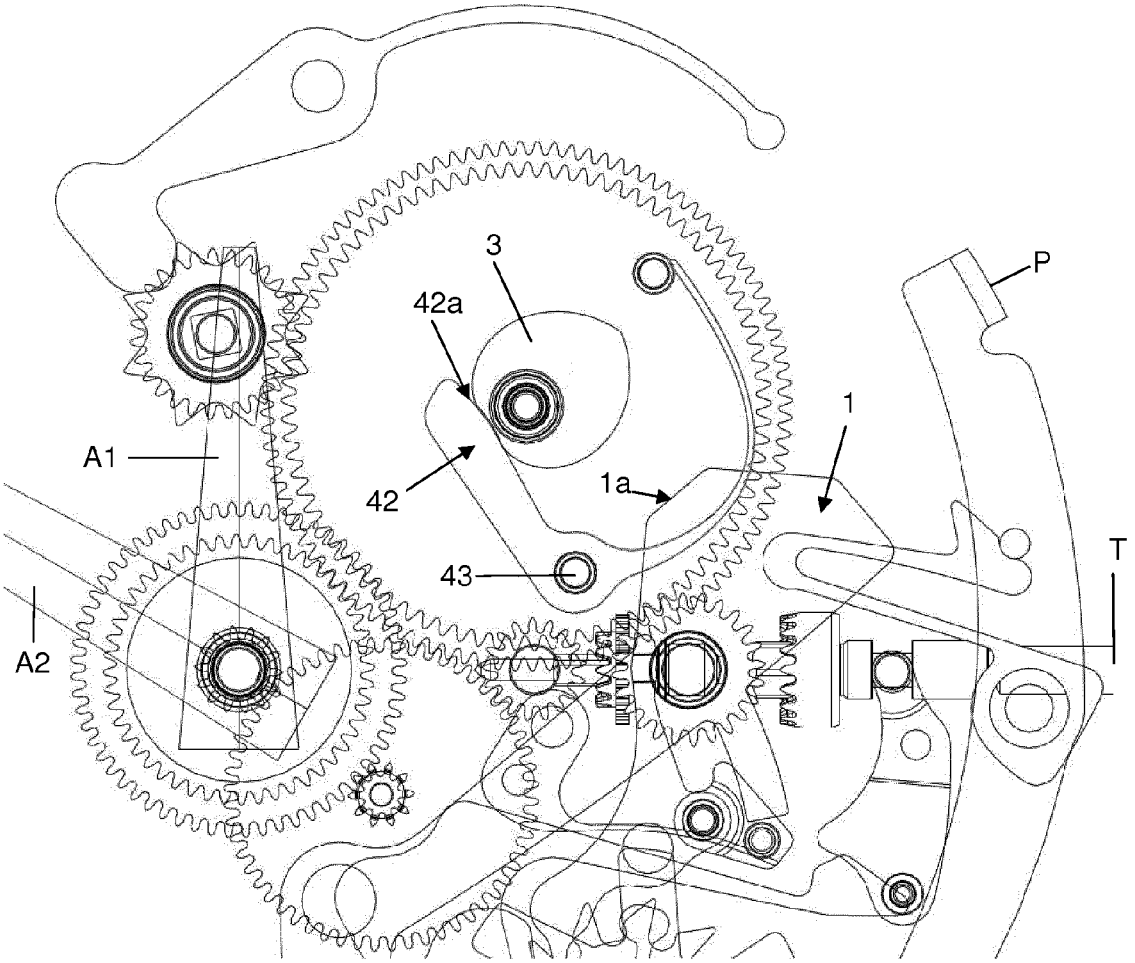
Figure 16:
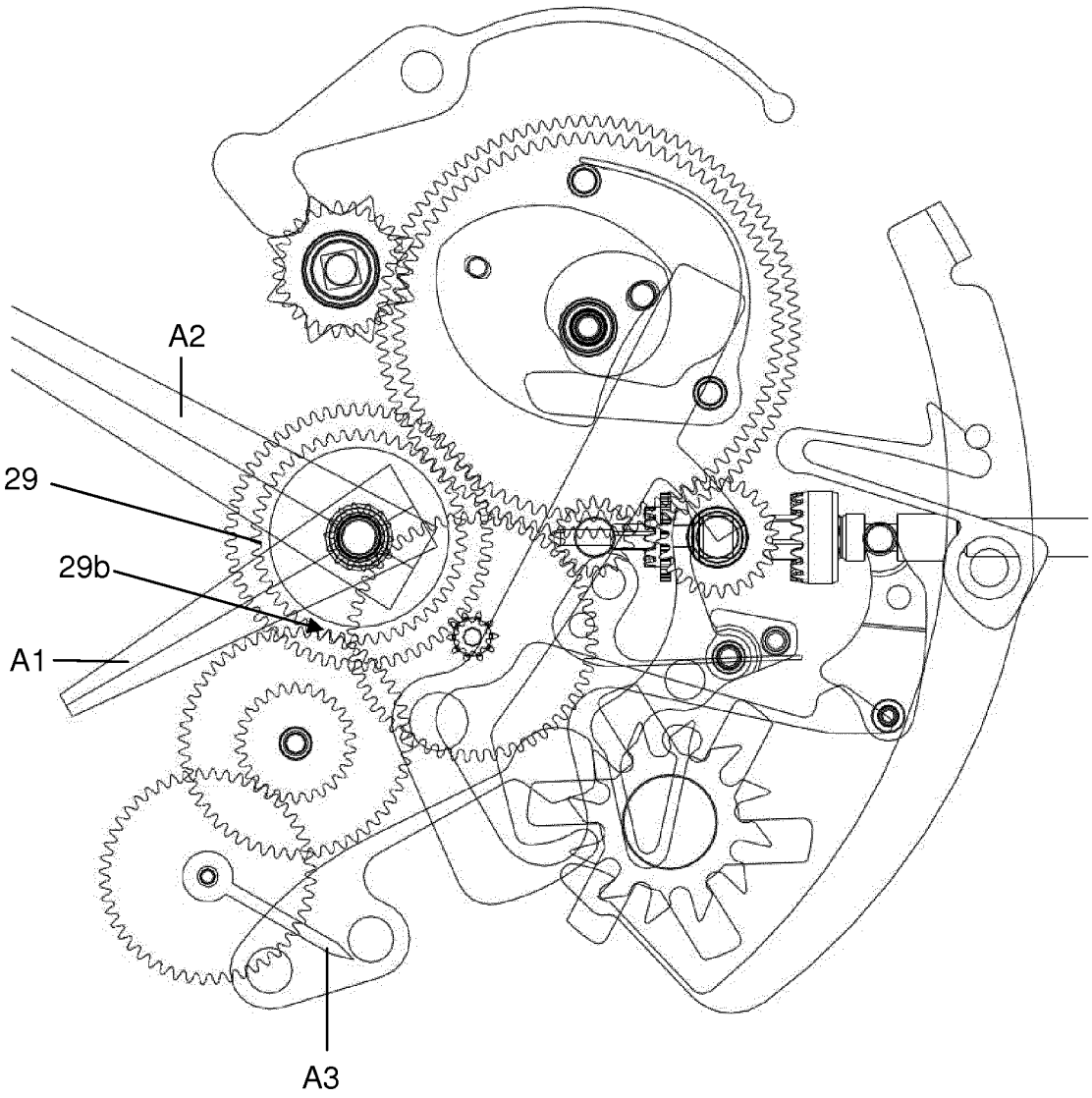
Figure 17:
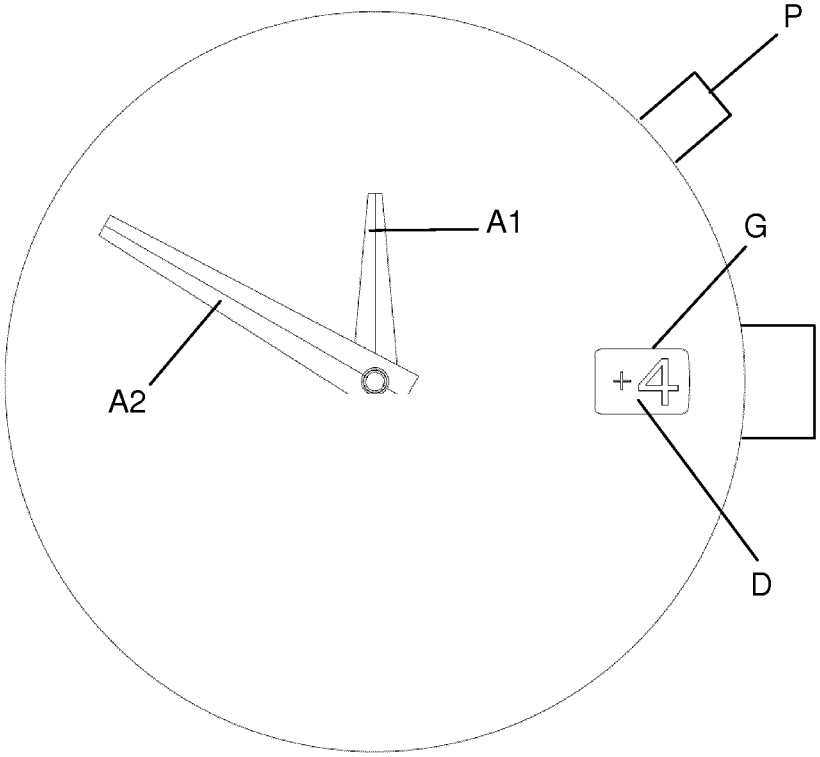
Figure 18:
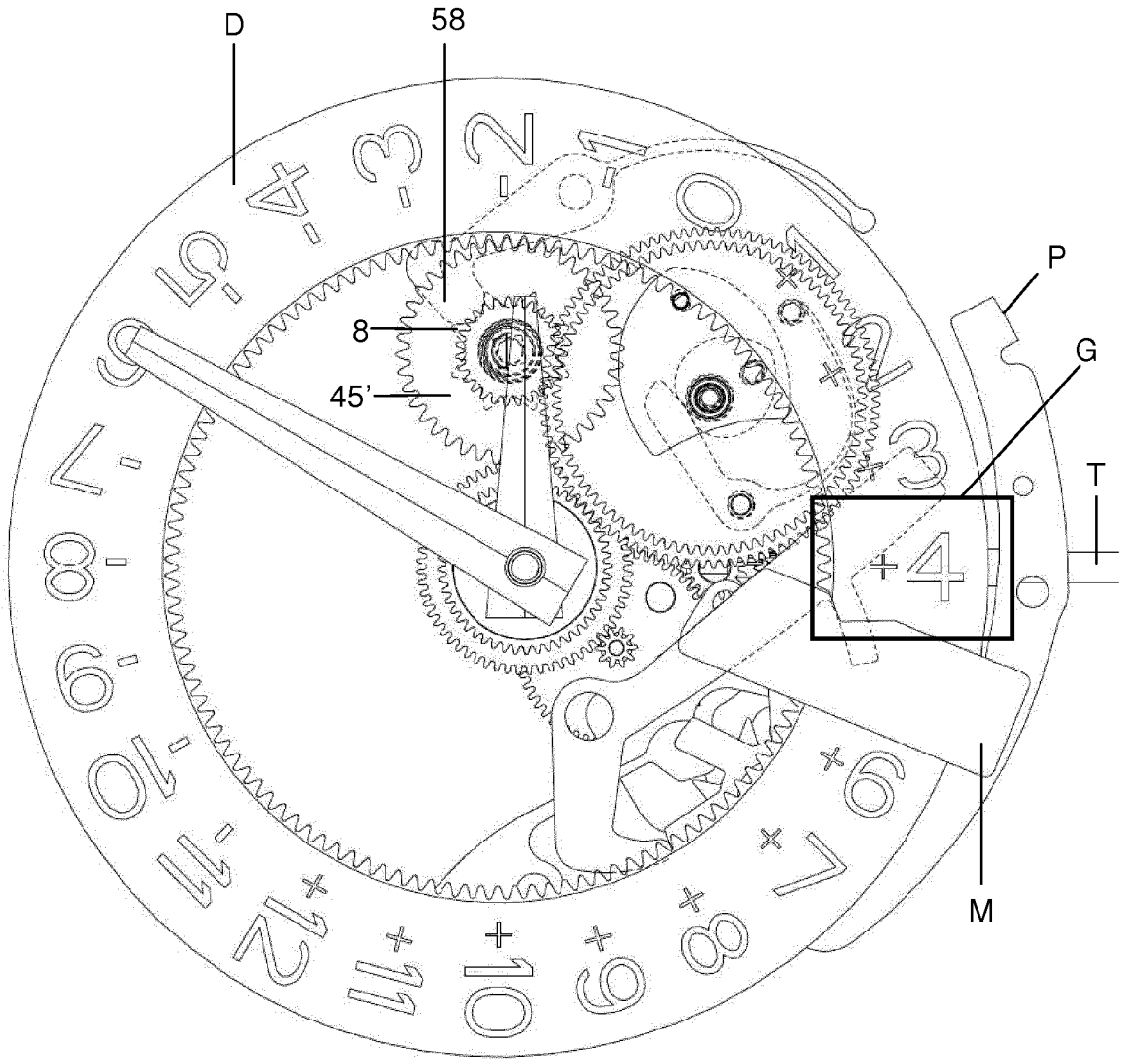
Figure 19:
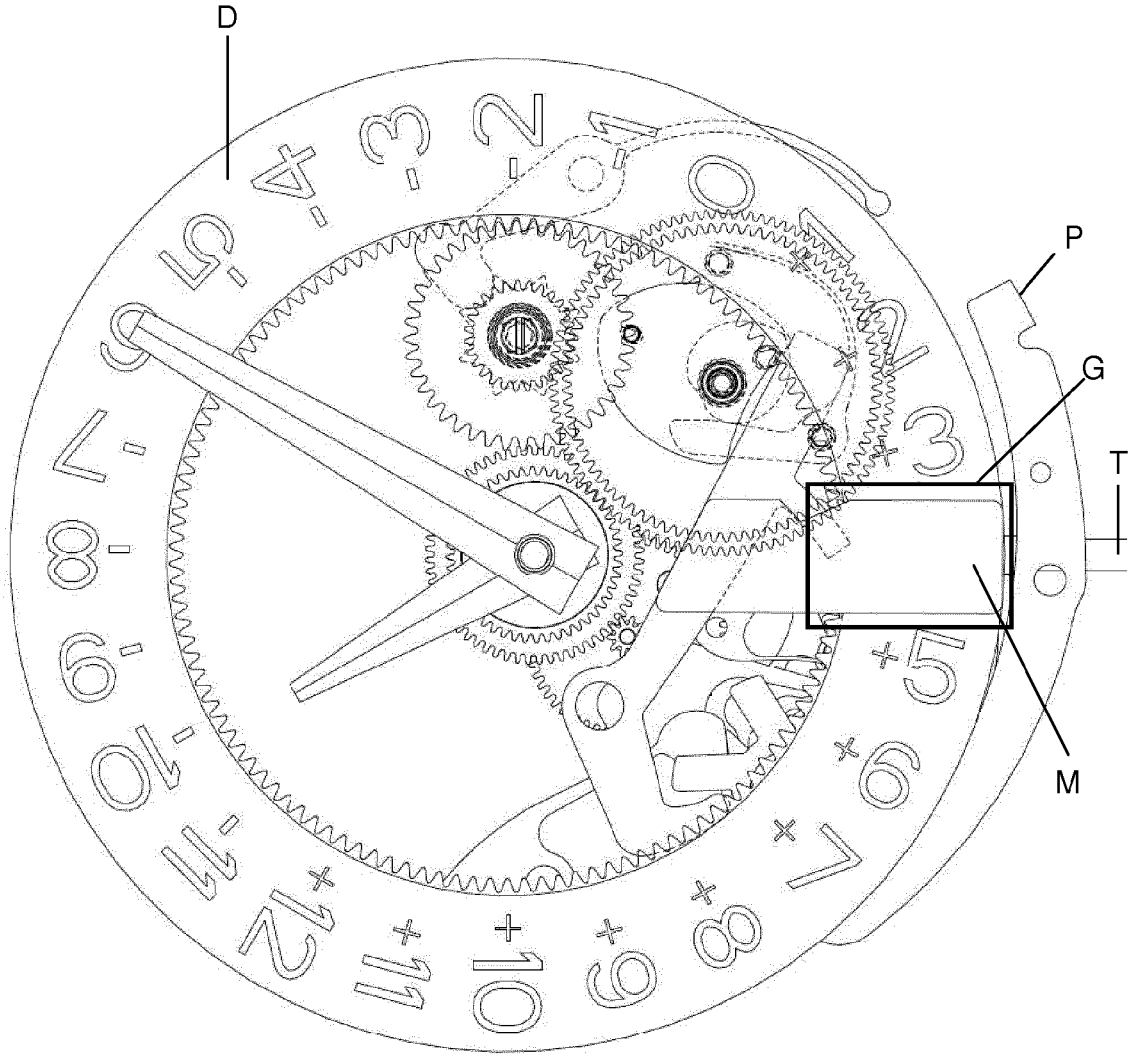
Figure 20:
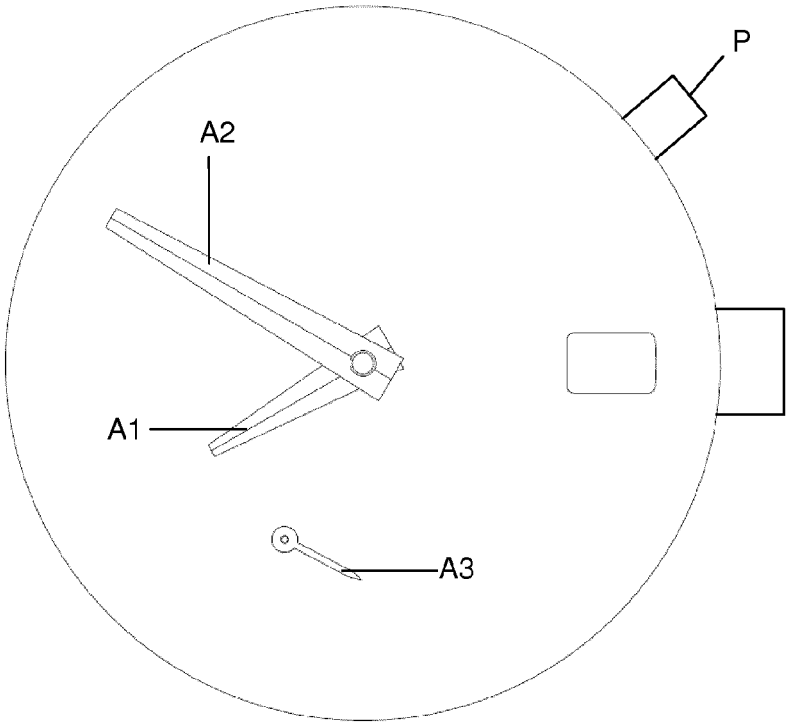
Figure 21:
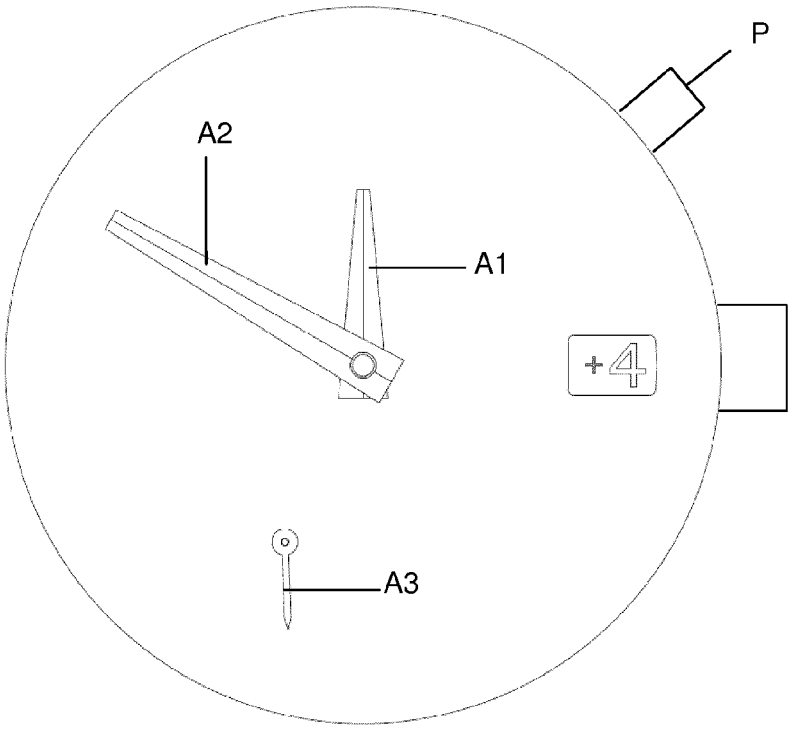

Other features and advantages of the invention will now be described in detail in the following explanation which is given with reference to the attached figures which schematically depict:

FIG. 1: a plan view of one embodiment of a timepiece according to the invention with a control stem in the position for setting the time of one of the time zones;

FIG. 2: a partial and enlarged view of FIG. 1;

FIG. 3: a plan view of the timepiece of FIG. 1, in the position for setting the other time zone;

FIG. 4: a detailed perspective view showing the mechanism for switching over between the displays of the time zones;

FIG. 5: a detailed perspective view showing a differential controlling the display member;

FIG. 6: a partial plan view of the timepiece of FIGS. 1, 2 and 3, with the control stem in the rewinding position;

FIG. 7: a plan view of an alternative form of embodiment in the position for setting one time zone;

FIG. 8: a plan view of the alternative form of FIG. 7, in the position for setting the other time zone;

FIG. 9: a view in section on VII-VII of the alternative form of FIGS. 7 and 8, showing the control stem in the rewinding position;

FIG. 10: a partial view from above of the alternative form of FIGS. 7 and 8, with the control stem in the rewinding position;

FIG. 11: a view in section on VII-VII of the alternative form of FIGS. 7 and 8 showing the control stem in the position for setting one time zone;

FIG. 12: a partial view from above of the alternative form of FIGS. 7 and 8, in the position for setting one time zone;

FIG. 13: a view in section on VII-VII of the alternative form of FIGS. 7 and 8 showing the control stem in the position for setting another time zone;

FIG. 14: a view from above of the alternative form of FIGS. 7 and 8, in the position for setting the other time zone;

FIG. 15: a partial view from above of another alternative form of embodiment; and FIG. 16: a view from above of the alternative form of FIGS. 7 and 8 comprising a first supplement;

FIGS. 17, 18 and 19: views from above of the alternative form of FIGS. 7 and 8 comprising a second supplement;

FIGS. 20 and 21: views from above of a timepiece according to the alternative form of FIG. 7 or of FIG. 15, comprising a first and a second supplement;

DETAILED DESCRIPTION OF THE INVENTION

The invention will be detailed and explained through various embodiments which are given solely by way of simple examples.

First Embodiment

A first embodiment of a display device 300 according to the invention is depicted in FIGS. 1, 2 and 3. The display device forms part of a timepiece 300, notably a wristwatch or is such a timepiece 300. The display device also forms part of a timepiece movement 200 or is such a timepiece movement, the timepiece movement itself forming part of the timepiece 300. The display device comprises a switchover mechanism 100 comprising two heart pieces 3 and 4 the angular offset of which defines the time difference between the two time zones. The heart piece 3 is designed to collaborate with a first end 1*a* of a first lever 1 and the heart piece 4 with the first end 2*a* of a second lever 2. These first and second levers 1, 2 are of elongate shape overall and are joined together, notably fixed one on the other. The first lever 1 is mounted on the second lever 2, the latter pivoting at a second end 2*b* about a pivot 39 fixed to the frame of the movement.

A second end 1*b* situated on one arm of the lever 1 is positioned, under the influence of a spring 6, by a two-position selection member 5, in this instance a column wheel 5. In the configuration depicted in FIG. 1, the second end 1*b* situated on the arm of the lever 1 is positioned or returned, under the influence of a spring 6, in one of the hollows 5*a* of the column wheel 5 the binary profile of which is formed by an alternation of hollows 5*a* and of columns 5*b*.

In FIGS. 1 and 2, the end 2*a* of the second lever 2 rests against the flat of the heart piece 4 and the hours hand A1 of the display member displays the time of the first time zone.

In the configuration depicted in FIG. 3, the end 1*b* of the lever 1 rests against one of the columns 5*b* of the column wheel 5.

The end 1*a* of the first lever 1 therefore presses against the flat of the heart piece 3 and the hours hand A1 displays the time in the second time zone.

Activation of one or other of the levers 1 and 2 is therefore performed by means of the column wheel 5. As may be seen in FIGS. 1 and 2, this column wheel 5 has a toothset 11 situated in a plane perpendicular to the longitudinal axes of the columns 5*b* and which is angularly indexed by a jumper 12. The column wheel 5 is designed to be actuated and driven in one direction by one angular step by the push-button P through the intermediary of a lever 36 having a hook-shaped end 13. It is of course entirely conceivable for this binary selection member 5 to be driven in two directions into two angular positions using a suitable control device. Such a solution makes it possible, for example, to use a column wheel 5 that has just one single column. Such a solution also allows the columns to be substituted by a toothset which is kinematically connected to a toothset secured to the lever 1, i.e. a toothset of which the teeth, by contact with the lever 1, determine the position of the lever 1.

It is of course entirely possible to reverse the setup of the levers 1 and 2, to make the lever 1 pivot about the pivot 39, and to attach the arm that collaborates with the column wheel to the lever 2.

FIG. 4 depicts in greater detail the switchover mechanism that switches over between the two time zones.

The heart pieces 3 and 4 are coaxial and able to rotate independently of one another. The heart piece 4 is secured to the wheel 7, notably fixed to the wheel 7, while the heart piece 3 is secured to the star 8, notably fixed to the star 8. The latter is in mesh with the wheel 7 through the intermediary of a jumper 9 pivoted at 10 on the plate of the wheel 7.

Thus, to adjust the time difference which is defined by the angular offset between the heart pieces 3 and 4, all that is required is the turning of the wheel 7 while keeping the star 8 in position.

FIG. 5 depicts in detail how the hours hand A1 is driven.

The timepiece movement provides an indication of time via a cannon pinion 27 and a traditional motion-work runner comprising a wheel 28 secured to a pinion 32. The hours hand A1 is mounted securely on the pivot of the output wheel 29 of a differential 29, 30, 33, 34 so that it can adopt two angular positions under the action of the wheel 7 meshing with a toothset 30*b* of the input wheel of the differential 30.

The differential 29, 30, 33, 34 is a spherical differential of known type.

In normal operation, and whatever the time zone displayed, the hand A1 indicates the time via the motion-work pinion 32 which meshes with the planet carrier 33.

The rotation of this wheel 33 is transmitted to the output wheel 29 of the differential via planets 34 which are in mesh, on the one hand, with the crown toothset 29*a* of the wheel 29 and, on the other hand, with a crown toothset 30*a* provided on the input wheel 30 of the differential.

Under the effect of that one of the levers 1 and 2 that is in contact with the flat of the heart piece 3 or of the heart piece 4 respectively, the wheels 30 and 7 are immobile.

Upon switchover, rotation of the heart pieces 3 and 4, under the effect of the collaboration between one of them and one of the two levers 1 and 2, causes the wheels 7 and 30 to rotate. The rotation of the wheel 30 is transmitted to the wheel 29 via the planets 34, while the planet carrier 33, in mesh with the motion-work pinion 32 of the basic movement, continues its collaboration with the lantern cannon pinion 27 which is held with friction on the center pinion of the basic movement (not depicted in the figures).

As far as the mechanism for correcting or setting the display is concerned, one of the specific features of the invention is that the time display device allows selective correction of only the time zone that is being displayed through the intermediary of a dedicated geartrain, this being a significant advantage over the mechanisms of the prior art.

The control stem T of the device can occupy a rewinding position I and a position II for setting the time of one or other of the time zones.

FIG. 6 depicts the configuration of the timepiece according to the invention that corresponds to the position I or rewinding position of the control stem T.

The watch is rewound via a winding pinion (not visible in FIG. 6) the ratchet teeth of which are in mesh with the ratchet teeth 14*a* of a sliding pinion 14 which is square mounted on the stem T and also provided with a crown toothset 14*b* facing the ratchet teeth 14*a*. This stem-sliding pinion-winder pinion device is entirely known.

Referring back again to FIG. 1, it may be seen that the configuration depicted corresponds to the position II or the position for correcting or setting the first time zone.

The transition from the position I to the position II takes place by pulling on the control stem T. Under the effect of the translational movement of the stem, a first pull-out piece 15 is turned by a first end 15*a*. This first pull-out piece 15 is pivoted in the bottom plate of the timepiece, at the pivot 15*c*. A first end 16*a* of a second pull-out piece 16 is mounted to rotate freely on the first pull-out piece 15.

The positions of the stem T are defined by the stepping performed by the jumper 17 collaborating in the known way with the first pull-out piece 15 at the second end 15*b* thereof.

The second pull-out piece 16 comprises a second end 16*b* which collaborates with a first rocking lever 18 by means of a pin 19 designed to move in a V-shaped slot 20 of the rocking lever 18, which slot 20 thus forms a cam way.

A second rocking lever 21 is mounted with the freedom to rotate via a first end 21*a* under a first end 18*a* of the first rocking lever 18.

A second end 18*b* of the first rocking lever 18 bears an intermediate setting wheel 23 able to collaborate with the crown toothset 14*b* of the sliding pinion 14 and an intermediate wheel 35.

A second end 21*b* of the second rocking lever 21 is positioned in a groove 22 formed in the sliding pinion 14, between its two toothsets 14*a* and 14*b*. Thus, when the stem is in the position I (FIG. 6), the second pull-out piece 16 drives the second rocking lever 21 so as to press the ratchet teeth 14*a* of the sliding pinion 14 firmly against the winding pinion (not depicted in the figure).

At the same time, it positions the pin 19 at a first end of the slot 20 and arranges the first rocking lever 18 in such a way that the intermediate setting wheel 23 borne by the latter cannot mesh with the other intermediate correction or setting wheels, notably the wheel 35.

When the stem is in position II (FIG. 1 or 2), the second pull-out piece 16 can adopt two angular positions under the effect of a return spring 24 and of a follower 25 a first end 25*a* of which is mounted with the freedom to rotate on the second pull-out piece 16 by means of the pivot 19 and a second end 25*b* collaborates with the two-position selection member 5, in this instance the column wheel 5, by means of a pin 26. Between its first 25*a* and second 25*b* ends the follower 25 has an oblong hole 37 allowing it to be guided by a pin 38 fixed to the bottom plate of the timepiece.

Each of the two abovementioned angular positions corresponds to one time zone and to the setting of this time zone using a dedicated geartrain.

First Time Zone

The angular position of the second pull-out piece 16 which allows the mechanism to correct the first time zone can be seen in FIG. 1.

In this position, the arrangement of the follower 25, of the column wheel 5 and of the rocking lever 18 is intended such that when the pin 26 is in one of the hollows 5*a* of the column wheel 5, the second pull-out piece 16 positions the pin 19 at a second end of the slot 20 and thus positions the rocking levers 18 and 21 in such a way that the geartrain for adjusting or correcting the first time zone is engaged. This geartrain passes through the intermediate setting 23, the intermediate wheel 35 and the motion-work runner 28, 32 which is kinematically linked to the planet carrier 33 of the differential.

Thus, rotating the stem T causes a trailing setting of the time of the hours hand A1 and of the minute hand A2.

In this configuration, as can be seen in FIG. 1, the lever 1 is arranged in such a way that its end 1*b* is in a hollow 5*a* of the wheel 5 which is different from the hollow in which the pin 26 is located.

The end 2*a* of the lever 2 therefore presses on the heart piece 4 which corresponds to the displaying of the first time zone.

Given that the heart piece 4 is immobilized by the lever 2 and secured to the wheel 7, as was explained before (in relation to FIG. 4), the wheel 7 is likewise immobilized. It then follows that the rotating of the control stem T turns the hand A1 via the differential 29, 30, 33, 34 and thus modifies the first time zone.

Second Time Zone

The angular position of the second pull-out piece 16 which allows the mechanism to correct the second time zone can be seen in FIG. 3.

In this position, the pin 26 fixed to the second end 25*b* of the follower 25 presses against one of the columns 5*b* of the column wheel 5. The pivot 19 is therefore positioned between the two ends, substantially at the middle, of the slot 20, and this positions the rocking levers 18 and 21 in such a way that the geartrain for correcting or setting the second time zone is engaged. This geartrain passes through the intermediate setting wheel 23, an intermediate geartrain 60, 61, 62 and the wheel 7 which is kinematically connected to the wheel 30 of the differential.

Thus, rotating the control stem T causes the wheel 7 to be rotated with respect to the star 8, which is kept in position, and leads to the rapid correction of the hours hand A1 in steps of one hour. The stepping is defined by the angular pitch of the star 8 and the elasticity of the jumper 9. Because of the differential 29, 30, 33, 34, the wheel 33 and the minute hand A2 remain immobile.

At the same time, as can be seen in FIG. 3, the lever 1 is arranged in such a way that its end 1*b* is pressed against one of the columns 5*b* of the column wheel 5 which is a different one from the one against which the pin 26 is pressed.

The end 1*a* of the lever 1 therefore presses against the heart piece 3 which corresponds to the displaying of the second time zone.

Given that the heart piece 3 is immobilized by the lever 1 and is secured to the star 8, as was explained previously (in conjunction with FIG. 4), the star 8 is also immobilized. Nevertheless, thanks to the jumper 9, the wheel 7 can turn. Turning the control stem T therefore drives the rotation of the hand A1 via the intermediary of the wheel 7 and of the differential 29, 30, 33, 34 and thus modifies the second time zone.

In consequence, the switchover mechanism and the mechanism for correcting or adjusting the time zone are always in phase and there is no risk of modifying the time in one time zone when this is not the one being indicated by the hand A1. Moreover, the drivetrain for correcting or setting one or other of the two time zones may advantageously be kinematically linked to the motion-work runner 28, 32. Thus, rotating the stem T causes a trailing setting of the hours hand A1 and of the minute hand A2 and in fact allows one or other of the two time zones to be adjusted.

In addition, collaboration between the switchover mechanism and the correction mechanism allows additional functionality to be achieved.

Indeed, the system according to the invention makes it possible, in a single operation, to select the displaying of one of the two time zones and to select the mechanism suited to correcting the time zone displayed. Moreover, this system does not require an additional mechanism designed to set the hours and the minutes of the time display device and does not require any additional setting member. Thus, this collaboration between the switchover mechanism and the correction mechanism has the advantage of simplifying the design and of reducing the number of parts by comparison with mechanisms known from the prior art which allow only the switching-over of the display, or the correcting of one or other of the two time zones independently of the mechanism for setting the hours and the minutes.

1$^{st}$ Alternative Form

According to a first alternative form of the time displaying device according to the invention depicted in FIGS. 7 to 14, the first lever 1 also has an elongate shape overall, but the second lever 42 has a part that forms a return spring 42*b*.

In addition, the first lever 1 and the second lever 42 are fixed on different pivots.

The first lever 1 is pivot mounted on a pivot 49, while the second lever 42 is pivot mounted on a pivot 43 fixed to the wheel 7 and comprises a return-spring-forming part 42*b* which is preloaded by a pin 47. The end 42*a* of the second lever 42 is constantly pressed against the heart piece 4. It is of course entirely conceivable to reduce the lever 42 to its end 42*a* and its pivot pin and make it collaborate with a return spring. The heart piece 4 is secured to a wheel 44 situated under the wheel 7 and meshing with an intermediate setting wheel 45 secured to the star 8, the latter being angularly indexed by the jumper 58 fixed to the frame of the movement.

Under the effect of the spring 46 which applies pressure to the first end 1*a* of the first lever 1, this end presses against the heart piece 3 and remains in contact with the flat of this heart piece 3. The pressing of the end 1*a* on the heart piece 3 overcomes the torque produced by the spring-forming part 42*b*, causes the second lever 42 to pivot about the pivot 43 and thus cancels the effect of the end 42*a* on the flat of the heart piece 4, the result of this being to cause the hand A1 to display the time in the first time zone.

The second end 1*b* situated on a foot of the first lever 1 is positioned by a two-position selection member 5, in this instance a column wheel 5. In this configuration that can be seen in FIG. 7, the second end 1*b* is positioned in one of the hollows 5*b* of the profile of the column wheel 5, under the influence of the spring 46 and because of the pivoting of the lever 1 about the pivot 49.

Pressure on the push-button P causes the column wheel 5 to rotate by one angular step, this having the consequence of pushing the end 1*b* of the lever 1 back against a column 5*b* of the profile of the column wheel 5, and thus of moving the end 1*a* of this lever 1 away from the heart piece 3 and thereby cancelling its action on the heart piece 3. This results in an angular rotation of the wheel 7 under the effect of the second lever 42 and of its part 42*b* that forms the spring until the end 42*a* of the second lever 42 comes to press against the flat of the heart piece 4 and causes the time in the second time zone to be displayed.

This configuration is depicted in FIG. 8. As may also be seen in this figure, it is advantageous to plan for the first lever 1 to have the specific feature of, aside from switching over the time display, operating the correction mechanism which is associated with the time zone displayed, which role in the embodiment of FIG. 1 was played mainly by the follower 25.

Although in this alternative form it is conceivable for the control stem T to comprise a sliding pinion 14 with opposed toothsets 14*a*, 14*b* as denoted by the numeral 14 in the embodiment depicted in FIGS. 1 to 6, it is possible, in place of this sliding pinion 14, to use a winding pinion that rotates as one with the control stem T independently of the sliding pinion and a sliding pinion that has a contrate toothset and a crown toothset.

Thus, FIGS. 7 to 14 show a winding pinion 51 which is square mounted on the stem T. The sliding pinion 52 comprises a contrate toothset 52*a* and a crown toothset 52*b* (this much is clearly visible in FIGS. 7 and 9).

The watch is rewound, when the stem is in position I (FIGS. 9 and 10), through the intermediary of the winding pinion 51 which is kinematically connected to the rewinding geartrain via its crown toothset 51*a*. In this configuration, the sliding pinion 52 is arranged in such a way as to engage no geartrain, either via its contrate toothset 52*a* or via its crown toothset 52*b*.

As can be seen in FIG. 11, the translational movement of the stem T into position II disengages the rewinding geartrain and causes the pull-out piece 50 to rotate.

The rewinding mechanism is therefore disengaged via a clutch which is perpendicular to the longitudinal axis of the control stem (T). For a detailed description of such a mechanism reference may be made to the European patent application filed on Jun. 21, 2011 under No. EP 11 405 272.3, whose priority is claimed in International Application No. PCT/EP2012/061936 and published on Dec. 27, 2012 under No. WO 2012/175595A9, and the content of which is incorporated by reference into the present description.

A rocking lever 53 bears a cam 54 pivot mounted on a pivot 55 fixed to this rocking lever. This cam 54 is held in position under the influence of a spring 56. The latter collaborates with a pin 57 fixed to the cam 54 so as to press the surface 54*a* of the cam 54 firmly against a flank 53*a* of the rocking lever 53.

If the push-button P selects the first time zone, which is the configuration visible in FIG. 12, the end 1*b* of the lever 1 lies between two columns 5*b*, i.e. in a hollow 5*a* of the profile of the column wheel 5.

One end 50*a* of the pull-out piece 50 comes into contact with a second end 54*b* of the cam 54.

Thus, the rocking lever 53 and the cam 54 pivot about the pivot 53' on which the rocking lever 53 is mounted.

This has the effect of causing the sliding pinion 52 to effect a translational movement against the force of a spring-forming part 53*b* of the rocking lever 53 and of establishing the meshing of the crown toothset 52*b* of the sliding pinion 52 with the intermediate wheel 35 of the geartrain for correcting or setting the first time zone. This correction geartrain passes through the motion-work runner 28, 32 which is kinematically connected to the planet carrier 33 of the differential.

Thus, a rotation of the stem T causes a trailing setting of the hours hand A1 and of the minute hand A2.

The configuration obtained when the second time zone is selected and the stem T is pulled into position 2 is depicted in FIGS. 13 and 14.

As can be seen in FIG. 14, the first lever 1, the end 1*b* of which presses against one of the columns 5*b*, comprises an arm 1*c*.

The end of the arm 1*c*, by coming into abutment against the pin 57, causes the cam 54 to pivot and prevents the end 50*a* of the pull-out piece 50 from coming into contact with the cam 54. This has no impact on the positioning of the rocking lever 53 which positioning is defined by the spring-forming part 53*b*.

The translational movement of the stem T from the position I to the position II therefore causes the sliding pinion 52 to move back under the effect of a spring-forming part 53*b* of the rocking lever 53.

As can be seen in FIGS. 13 and 14, in this position, the contrate toothset 52*a* of the sliding pinion 52 meshes with the crown toothset 59*a* of the first intermediate setting 59 of the correction geartrain provided for setting the second time zone.

This correction geartrain passes through the wheel 44, which rotates as one with the star 8 and with the wheel 7 via the heart piece 4 and the lever 42. Thus, rotating the control stem T causes the second time zone to be set using the rapid correction of the hours hand A1 in steps of one hour. The stepping is defined by the angular pitch of the star 8 and the elasticity of a jumper 58 collaborating therewith.

Because of the differential 29, 30, 33, 34, the minute hand A2 continues to rotate under the effect of the basic movement.

By comparing FIGS. 11 and 13 it will be noticed that the axial position of the sliding gear 52 differs according to whether the push-button P selects the first or the second time zone, which means that the sliding pinion 52 may, respectively, drive the wheel 35 of the geartrain for correcting the first time zone, by means of its crown toothset 52*b*, or the intermediate setting wheel 59 of the geartrain for correcting or setting the second time zone, using its contrate toothset 52*a*.

Second Alternative Form

FIG. 15 depicts a second alternative form of the time displaying device according to the invention.

The essential difference by comparison with the first alternative form is that the time displaying device has just one heart piece 3.

In this embodiment, the flanks of the first and second levers 1, 42 collaborate with the profile of the single heart piece 3. Thus, this heart piece 3 may be given a thickness that is greater than that of the heart piece in the other alternative forms. Likewise, as can be noted by comparing FIGS. 14 and 15, the shape of the lever 1 may be have been modified.

Supplements

1st Supplement

Whatever the embodiment or alternative form considered, it is possible to add, to the time displaying device according to the invention, indications that are in addition to that of the time of the time zone selected.

Thus, according to a third alternative form of the time displaying device according to the invention depicted in FIG. 16, an additional stepdown geartrain is provided intended to collaborate with the toothset 29*b* of the output wheel 29 of the differential (cf. FIG. 5).

This geartrain is intended to indicate the time in the selected time zone over a 24 hour cycle using an additional hand A3.

2nd Supplement

Whatever the embodiment or alternative form considered, in another supplement depicted in FIGS. 17 to 21, the star 8 which, as was seen in the foregoing alternative forms, memorizes the time difference between the two time zones, is secured to a wheel meshing with a disk D.

The first time zone can therefore be defined as being the reference time zone and the second time zone as being that of a place in which the wearer of the watch is going to spend some time and which is set relative to the reference first time zone.

The time difference display disk D is kinematically connected to the second time zone rapid correction star 8 via the additional wheel 45'.

Thus, when the device is displaying the second time zone (FIGS. 17, 18, 19, 14), rapid correction by means of the control stem T, which is positioned beforehand in position II, causes the hours hand A1 to jump in steps of one hour and drives the disk D which counts up the number of hours separating the second time zone from the reference first time zone.

The disk D is graduated over a range of 24 hours and the stepping of the two indicator members A1 and D is defined only by the angular pitch of the star 8 which collaborates with the return spring 58.

In this configuration, the indication of the time difference can be viewed through an aperture G which is situated at the 3-o'clock position on the dial (FIG. 18). As FIG. 19 depicts, the disk D is not covered by a mask M. This mask M may be added to the lever 1 or collaborate therewith, notably through the intermediary of an appropriate geartrain.

This lever 1 has a perfectly defined angular position for each of the two time zones because of the collaboration between the end 1*b* of the lever 1 and the profile 5*a*, 5*b* of the column wheel 5. Thus, the mask M is arranged in such a way as to not cover the indication of the disk D appearing within the aperture G when the end 1*b* of the lever 1 is positioned against one of the columns of the profile 5*b* of the column wheel 5 (FIG. 14), which configuration corresponds to the selection to display the second time zone.

Pressure on the control member P causes the column wheel 5 to rotate by one angular step and this has the impact of positioning the end 1*b* of the lever 1 in one of the hollows 5*a* (FIG. 7) and therefore of modifying the angular position of the lever 2 and of the mask M so as to cause the time in the reference first time zone to be displayed and the indication of the disk D within the aperture G to be covered (FIGS. 19, 20). The mask may bear an indication that is visible in the aperture in this position. This indication for example makes it possible to identify the first time zone. In this configuration, correction using the control stem T, which is positioned beforehand in position II, has no impact on the angular position of the disk D because the time correction geartrain passes through the motion-work runner rather than through the correction star 8. Thus, rotating the control stem T leads to a trailing setting of the hours hand A1 and of the minute hand A2 independently of the disk D.

Thus, the disk D that indicates the time difference, which is displayed intermittently, operates in a similar way to a disk that displays the time difference permanently.

It then follows that no additional energy needs to be provided within the mechanisms of the first and second alternative forms in order to introduce this additional indication. Only a bistable device, driven by the switchover mechanism is needed in order to uncover the time difference display disk intermittently.

If this second supplement is combined with the first one which comprises a hand A3 indicating the time over a 24-hour cycle (FIG. 16), it is possible to display the time in two time zones unequivocally and allow ease of adjustment of the time in the local time zone using the time difference display disk D without thereby cluttering the dial and compromising the legibility of the time information.

The watch depicted in FIG. 20 indicates that it is 07:50 in the reference time zone UTC 0, for example in London. Pressure on the push-button P displays the time in the location of the wearer while at the same time indicating the number of hours separating this second time zone from the reference time zone. In FIG. 21, the watch is therefore indicating that it is 11:50 in Dubai (UTC+4).

This document makes mention of a "two-position selection member". One example of such a member is a column wheel. Quite clearly such a member can occupy more than two positions, notably 12 distinct positions in the case of a wheel with six columns, a first set of six positions such that the first lever is in a first given position and a second set of six positions such that the first lever is in a second given position. Quite clearly the "two-position selection member" covers any selection member capable of positioning the first lever in at least two distinct positions, notably at least two distinct stable positions.

It will be noted that the device according to the invention makes it possible to select the mechanism for correcting the time zone displayed, notably the geartrain for setting or correcting the time zone displayed, using one and the same switchover mechanism. The mechanism for setting or correcting one or other of the two time zones may notably be a time setting mechanism which is associated with the minutes setting mechanism.

The invention claimed is:

1. A device for displaying the time, notably a timepiece or a timepiece movement, wherein the device comprises a time display member and a switchover mechanism allowing the time display member to switch over between a first time zone and a second time zone and/or to select a first geartrain for setting the first time zone or a second geartrain for setting the second time zone, this switchover mechanism comprising:

a first heart piece able to rotate, connected to the time display member by a drivetrain, a first lever having a first end designed to collaborate with the first heart piece in order to cause the time display member to indicate the time in the first time zone, a second lever designed to make the time display member indicate the time in the second time zone, a two-position selection member collaborating with the first lever, and a control member for selecting the first or the second time zone to be displayed and which collaborates with the two-position selection member, wherein the two-position selection member is designed to collaborate directly with a second end of the first lever.

2. The device as claimed in claim 1, in which the first lever and the second lever each have an elongate shape overall.

3. The device as claimed in claim 1, in which the first lever and the second lever are joined together.

4. The device as claimed in claim 3, in which the first lever is fixed to the second lever.

5. The device as claimed in claim 1, in which the first lever has an elongate shape overall and the second lever has a part that forms a spring.

6. The device as claimed in claim 5, in which the second lever constantly presses against the first heart piece.

7. The device as claimed in claim 1, further comprising a second heart piece coaxial with the first heart piece, able to rotate independently of the latter, connected to the time display member by a second drivetrain and designed to collaborate with said second lever.

8. The device as claimed in claim 1, comprising a control stem able to occupy at least two positions, the control stem, in one of these positions, collaborating with the control member and/or with the selection member so as to set the time in the first or second time zone selected by the control member and displayed by the time display member.

9. The device as claimed in claim 8, in which the positions of the control stem comprise a rewind position and a time-setting position, the control stem, in the time-setting position, collaborating with the control member and/or with the selection member so as to set the time in the first or second time zone selected by the control member and displayed by the time display member.

10. The device as claimed in claim 8, in which a winding pinion is mounted on the control stem and rotates as one therewith.

11. The device as claimed in claim 8, in which the control stem comprises a sliding pinion provided with a contrate toothset and with a crown toothset.

12. The device as claimed in claim 8, comprising a clutch perpendicular to a longitudinal axis of the control stem and collaborating with a winding pinion so as to actuate a winding mechanism.

13. The device as claimed in claim 1, in which the first and second setting geartrains are distinct.

14. The device as claimed in claim 1, in which the device comprises selection means for selecting the first or second setting geartrain corresponding to the time zone selected and displayed by the time display member and by means of which the time is to be set.

15. The device as claimed in claim 14, in which a control stem collaborates with a pull-out piece itself collaborating, firstly, with at least one rocking lever to set the time, and secondly, with said selection means that select the first or second setting geartrain.

16. The device as claimed in claim 14, in which the means for selecting the first or second setting geartrain comprise, firstly, a second pull-out piece collaborating with a first pull-out piece, a first rocking lever and a second rocking lever and, secondly, a follower collaborating with the second pull-out piece, the first rocking lever, the second rocking lever and a column wheel.

17. The device as claimed in claim 14, in which the selection means that select the first or second setting geartrain comprise a cam and an arm provided on the first lever and collaborating with the cam.

18. The device as claimed in claim 17, in which one end of the arm of the first lever is designed to collaborate with a pin fixed to the cam so as to cause the latter to pivot in such a way that the cam drives a rocking lever via the rotating of the pull-out piece.

19. The device as claimed in claim 1, in which the first and second setting geartrains are connected to two distinct inputs of a differential.

20. The device as claimed in claim 1, in which one or other of the first and second setting geartrains is kinematically connected to the minutes indication.

21. The device as claimed in claim 1, further comprising a hand designed to indicate the time in the time zone selected by the control member over a 24-hour cycle.

22. The device as claimed in claim 1, further comprising a time difference display member, for displaying a time difference between the two time zones.

23. The device as claimed in claim 22, in which the time difference display member collaborates with the control member in such a way as to be visible only when one of the two time zones is displayed.

24. The device as claimed in claim 23, comprising a dial provided with an aperture and a mask provided between the time difference display member and a dial of the device, in order, depending on a position of the first lever to either mask or not mask the part of the time difference display member that is situated facing the aperture.

25. The device as claimed in claim 24, in which the mask is fixed to the first lever or collaborates therewith.

26. A device for displaying the time, notably a timepiece or a timepiece movement, comprising a time display member and a switchover mechanism allowing the time display member to switch over between two time zones and/or to select a correction geartrain of one of the two time zones, wherein the device further comprises a time difference display member for displaying the time difference between the two time zones, and wherein the time difference display member collaborates with a control member in such a way as to be visible only when one of the two time zones is displayed.

27. The device as claimed in claim 26, in which the switchover mechanism comprises:

a heart piece able to rotate, connected to the time display member by a drivetrain, a first lever having a first end designed to collaborate with the heart piece in order to cause the time display member to indicate the time in the one of the two time zones, a second lever designed to make the time display member indicate the time in the other time zone, a two-position selection member collaborating with the first lever, and a control member for selecting one or other of the time zones to be displayed and which collaborates with the two-position selection member.

28. The device as claimed in claim 27, comprising a dial provided with an aperture and a mask provided between the time difference display member and the dial of the device, in order, depending on a position of the first lever to either mask or not mask the part of the time difference display member that is situated facing the aperture.

29. The device as claimed in claim 28, in which the mask is fixed to the first lever or collaborates therewith.

30. The device as claimed in claim 26, wherein the time display member is a time display member that displays through an intermediary of moving parts.

31. The device as claimed in claim 26, wherein the time difference display member displays a time difference between the two time zones in numbers of hours.

32. A device for displaying the time, notably a timepiece or a timepiece movement, comprising a time display member and a switchover mechanism allowing the time display member to switch over between two time zones, wherein the device comprises a time difference display member for displaying the time difference between the two time zones, wherein the switchover mechanism comprises:

a heart piece able to rotate, connected to the display member by a drivetrain, a first lever having a first end designed to collaborate with the heart piece in order to cause the display member to indicate the time in the one of the two time zones, a second lever designed to make the display member indicate the time in the other time zone, a two-position selection member collaborating with the first lever, and a control member for selecting one or other of the time zones to be displayed and which collaborates with the two-position selection member, and wherein the device comprises a dial provided with an aperture and a mask provided between the time difference display member and the dial of the device, in order, depending on a position of the first lever to either mask or not mask the part of the time difference display member that is situated facing the aperture.

33. The device as claimed in claim 32, in which the mask is fixed to the first lever or collaborates therewith.

* * * * *